US005756043A

United States Patent [19]

Coble

[11] Patent Number: 5,756,043

[45] Date of Patent: May 26, 1998

[54] CAST REFRACTORY BASE SEGMENTS AND MODULAR FIBER SEAL SYSTEM FOR PLURAL-STACK ANNEALING FURNACE

[76] Inventor: Gary L. Coble, R.D. #2, Box 214, DuBois, Pa. 15801

[21] Appl. No.: 715,435

[22] Filed: Sep. 18, 1996

Related U.S. Application Data

[63] Continuation-in-part of Ser. No. 423,009, Apr. 14, 1995, Pat. No. 5,562,879, Ser. No. 674,996, Jul. 3, 1996, Pat. No. 5,681,525, Ser. No. 423,010, Apr. 14, 1995, Pat. No. 5,578,264, Ser. No. 647,676, May 15, 1996, Pat. No. 5,575,970, Ser. No. 32,591, Dec. 21, 1994, Pat. No. Des. 374,073, Ser. No. 32,587, Dec. 21, 1994, Ser. No. 32,590, Dec. 21, 1994, Pat. No. Des. 382,339, Ser. No. 32,588, Dec. 21, 1994, Pat. No. Des. 374,072, Ser. No. 51,631, Mar. 14, 1996, abandoned, Ser. No. 51,620, Mar. 14, 1996, abandoned, Ser. No. 51,626, Mar. 14, 1996, Ser. No. 51,616, Mar. 14, 1996, abandoned, Ser. No. 51,617, Mar. 14, 1996, abandoned, Ser. No. 51,615, Mar. 14, 1996, abandoned, Ser. No. 51,624, Mar. 14, 1996, abandoned, Ser. No. 51,625, Mar. 14, 1996, abandoned, and Ser. No. 51,635, Mar. 14, 1996, abandoned, said Ser. No. 674,996, is a division of Ser. No. 423,009, said Ser. No. 647,676, is a division of Ser. No. 423,010, said Ser. No. 51,631, Ser. No. 51,620, Ser. No. 51,626, Ser. No. 51,616, Ser. No. 51,617, Ser. No. 51,615, Ser. No. 51,624, Ser. No. 51,625, and Ser. No. 51,635, each is a continuation-in-part of Ser. No.423,009, Ser. No. 423,010, Ser. No. 32,593, Dec. 21, 1994, abandoned, Ser. No. 32,592, Dec. 21, 1994, Pat. No. Des. 371,837, Ser. No. 32,591, Ser. No. 32,587, Ser. No. 32,589, Dec. 21, 1994, Pat. No. Des. 371,836, Ser. No. 32,590, and Ser. No. 32,588, said Ser. No. 423,009, and Ser. No. 423,010, each is a continuation-in-part of Ser. No.32,593, Ser. No. 32,592, Ser. No. 32,591, Ser. No. 32,587, Ser. No. 32,589, Ser. No. 32,590, and Ser. No. 32,588.

[51] Int. Cl.[6] ..... C21B 7/04

[52] U.S. Cl. ..... 266/44; 266/263; 266/283; 52/596

[58] Field of Search ..... 266/44, 263, 252, 266/280, 283, 286; 52/576

[56] References Cited

U.S. PATENT DOCUMENTS

| | | | |
|---|---|---|---|
| 257,630 | 5/1882 | Whitney | 446/85 |
| D. 344,350 | 2/1994 | De Pascale et al. | D25/113 |
| 1,829,320 | 10/1931 | White | 266/286 |
| 2,998,236 | 8/1961 | Cramer et al. | 263/40 |

(List continued on next page.)

FOREIGN PATENT DOCUMENTS

| | | | |
|---|---|---|---|
| 1131246 | 12/1956 | Germany | 266/262 |

OTHER PUBLICATIONS

Lee Wilson Engineering Co., Brochure Entitled "Lee Wilson—Foremost Engineers & Manufacturers of Annealing Furnaces & Auxiliary Equipment," 8 pages, 6/68.

*Primary Examiner*—Scott Kastler
*Attorney, Agent, or Firm*—David A. Burge

[57] ABSTRACT

A rigid ceramic refractory base for a plural-stack annealing furnace—such as an eight-stack furnace that has two "four-stack rows" or "halves" arranged side by side—is assembled atop a base support structure utilizing a novel set of cast refractory segments, including spaced sets of inner segments, with each set of inner segments being surrounded by a sub-set of outer segments. Defined between each set of inner segments and its surrounding sub-set of outer segments is a circular inner seal positioning trough that opens upwardly, and that has a tapered cross section that narrows with depth. A resilient but reinforced inner seal of novel form is installed in each of the troughs, with each of these seals utilizing upper and lower blankets of refractory fiber material that sandwich a plurality of elongate refractory fiber modules arranged end-to-end to circumferentially fill the trough. Each of the modules includes a serial array of compressed, cube-shaped blocks of fiber refractory material that are interspersed with thin, perforated metal members, with each of the arrays of fiber blocks and metal members being held together to form a module by metal rods that extend centrally therethrough and are welded to perforated metal members that cap opposite module ends. Associated methods of fabrication, assembly, use, maintenance, repair and replacement are disclosed.

192 Claims, 11 Drawing Sheets

U.S. PATENT DOCUMENTS

| | | | |
|---|---|---|---|
| 3,039,754 | 6/1962 | Jones | 263/47 |
| 3,081,074 | 3/1963 | Blackman et al. | 263/47 |
| 3,149,827 | 9/1964 | Whitten | 263/47 |
| 3,693,955 | 9/1972 | Wald et al. | 266/5 |
| 4,011,683 | 3/1977 | De Sousa | 46/25 |
| 4,287,940 | 9/1981 | Corbett, Jr. | 165/48 |
| 4,294,438 | 10/1981 | Nystrom et al. | 266/280 |
| 4,310,302 | 1/1982 | Thekdi | 432/205 |
| 4,366,255 | 12/1982 | Lankard | 501/95 |
| 4,516,758 | 5/1985 | Coble | 266/263 |
| 4,611,791 | 9/1986 | Coble | 266/263 |
| 4,647,022 | 3/1987 | Coble | 266/282 |
| 4,653,171 | 3/1987 | Coble | 29/455 |
| 4,755,236 | 7/1988 | Coble | 148/13 |
| 5,048,802 | 9/1991 | Coble | 266/263 |
| 5,308,046 | 5/1994 | Coble | 266/263 |
| 5,335,897 | 8/1994 | Coble | 266/286 |
| 5,483,548 | 1/1996 | Coble | 373/75 |
| 5,562,879 | 10/1996 | Coble | 266/252 |
| 5,575,970 | 11/1996 | Coble | 266/44 |
| 5,578,264 | 11/1996 | Coble | 266/283 |

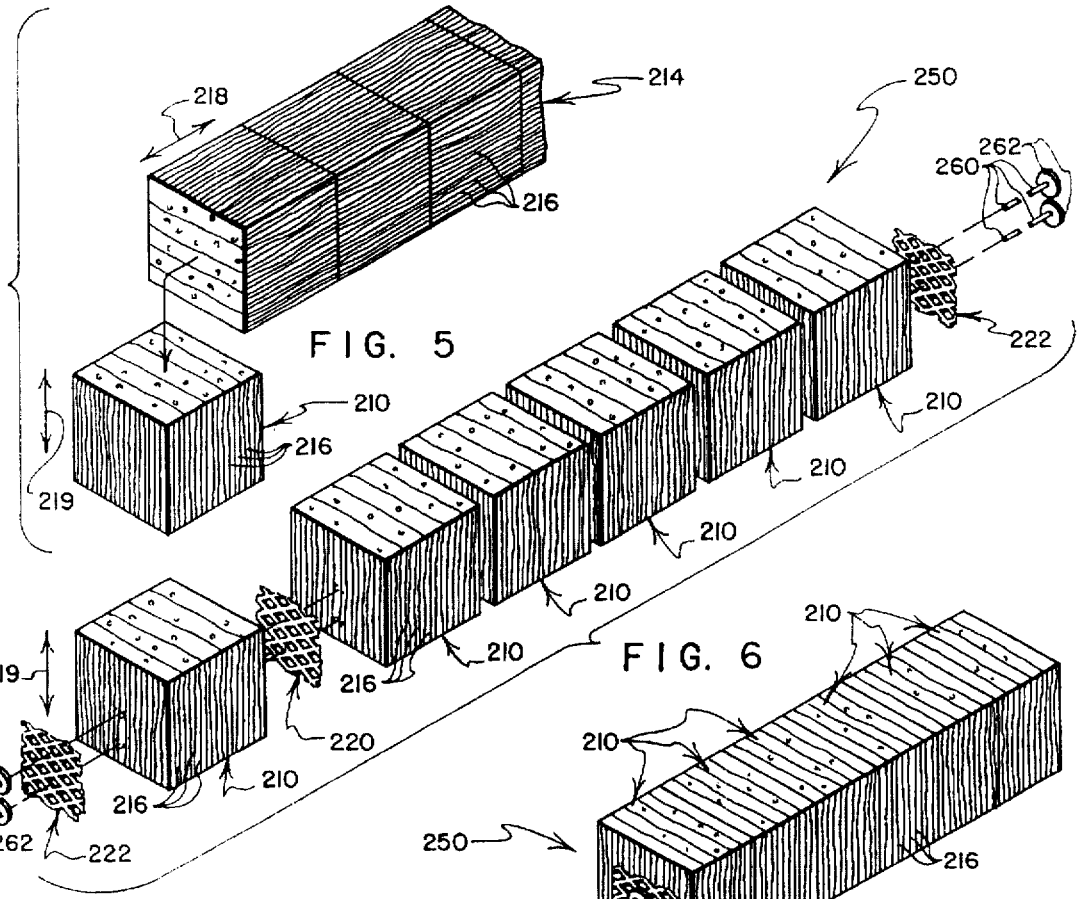
FIG. 5
FIG. 6
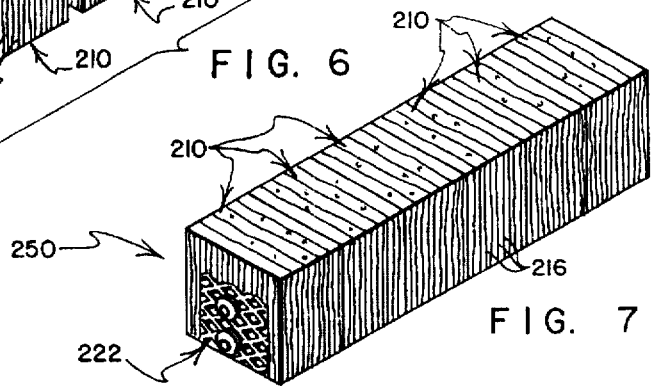
FIG. 7
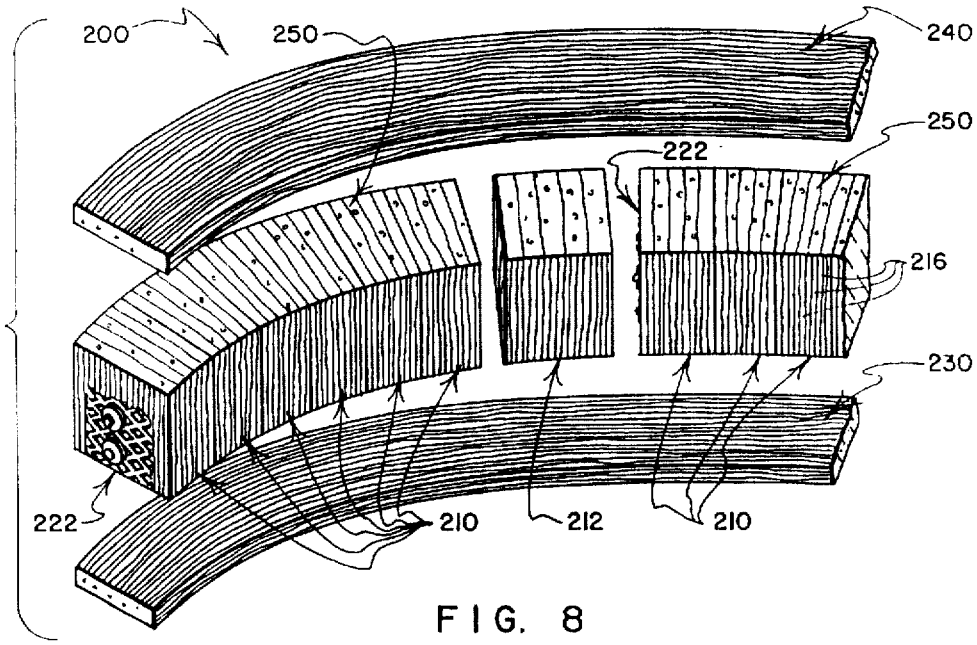
FIG. 8

CAST REFRACTORY BASE SEGMENTS AND MODULAR FIBER SEAL SYSTEM FOR PLURAL-STACK ANNEALING FURNACE

CROSS-REFERENCE TO RELATED APPLICATIONS

The present application is a continuation-in-part of each of the following four utility applications of Gary L. Coble, the disclosures of which are incorporated herein by reference:

U-1) CAST REFRACTORY BASE SEGMENTS AND MODULAR FIBER SEAL SYSTEM FOR SINGLE-STACK ANNEALING FURNACE, Ser. No. 08/423,009 filed Apr. 14, 1995, issued Oct. 8, 1996 as U.S. Pat. No. 5,562,879;

U-2) CAST REFRACTORY BASE SEGMENTS AND MODULAR FIBER SEAL, SYSTEM FOR SINGLE-STACK ANNEALING FURNACE, Ser. No. 08/674,996 now U.S. Pat. No. 5,681,525 filed Jul. 3, 1996 as a division of Ser. No. 08/423,009;

U-3) CAST REFRACTORY BASE SEGMENTS AND MODULAR FIBER SEAL SYSTEM FOR PLURAL-STACK ANNEALING FURNACE, Ser. No. 08/423,010 filed Apr. 14, 1995 now U.S. Pat. No. 5,578,264; and, U-4) CAST REFRACTORY BASE SEGMENTS AND MODULAR FIBER SEAL SYSTEM FOR PLURAL-STACK ANNEALING FURNACE, Ser. No. 08/647,676 now U.S. Pat. No. 5,575,970 filed May 15, 1996 as a division of Ser. No. 08/423,010.

The two utility applications designated "U-1)" and "U-3)" were filed as continuations-in-part of the following seven design applications:

D-1) CAST REFRACTORY CENTER SEGMENT OF ANNEALING FURNACE BASE, Ser. No. 29/032,593 file December 21, 1994, now abandoned;

D-2) CAST REFRACTORY CENTER SEGMENT OF ANNEALING FURNACE BASE, Ser. No. 29/032,592; filed Dec. 21; 1994, issued Jul. 16, 1996 as U.S. Pat. Des. No. 37,837;

D-3) CASE REFRACTORY SIDE SEGMENT OF ANNEALING FURNACE BASE, Ser. No. 29/032,591 filed Dec. 21, 1994, issued Sep. 24, 1996 as U.S. Pat. Des. No. 374,073;

D-4) ASSEMBLY OF CAST REFACTORY SEGMENTS OF ANNEALING FURNACE BASE, Ser. No, 29/032,587 filed Dec. 21, 1994;

D-5) ASSEMBLY OF CAST REFACTORY SEGMENTS OF ANNEALING FURNACE BASE, Ser. No. 29,032,589 filed Dec. 21, 1994, issued Jul. 16, 1996 as Patent-371,836;

D-6) ARCUATE CAST REFRACTORY AND STEEL SEGMENT OF ANNEALING FURNACE BASE, Ser. No. 29/032,590 filed Dec. 21, 1994; now U.S. Pat. Des. No. 382,339 and, D-7) ASSEMBLY OF ARCUATE CAST REFRACTORY AND STEEL SEGMENTS OF ANNEALING FURNACE BASE, Ser. No. 29/032,588 filed Dec. 21, 1994 issued Sep. 24, 1996 as U.S. Pat. Des. No. 374,072.

The present application also is a continuation-in-part of each of the co-pending design applications designated as "D-3)," "D-4)," "D-6)" and "D-7)" above.

The present application also is a continuation-in-part of each of the following co-pending design applications of Gary L. Coble, the disclosures of which are incorporated herein by reference:

D-8) ASSEMBLY OF CAST REFRACTORY SEGMENTS OF AN ANNEALING FURNACE BASE, Ser. No. 29/051,631 filed Mar. 14, 1996; now abandoned D-9) ASSEMBLY OF CAST REFRACTORY SEGMENTS OF AN ANNEALING FURNACE BASE, Ser. No. 29/051,620 filed Mar. 14, 1996; now abandoned D-10) ASSEMBLY OF CAST REFRACTORY SEGMENTS OF AN ANNEALING FURNACE BASE, Ser. No. 29/051,626 filed Mar. 14, 1996;

D-11) ASSEMBLY OF CAST REFRACTORY SEGMENTS OF AN ANNEALING FURNACE BASE, Ser. No. 29/051,616 filed Mar. 14, 1996; now abandoned D-12) ASSEMBLY OF CAST REFRACTORY SEGMENTS OF AN ANNEALING FURNACE BASE, Ser. No. 29/051,617 filed Mar. 14, 1996; now abandoned D-13) CAST REFRACTORY CORNER SEGMENT OF AN ANNEALING FURNACE BASE, Ser. No. 29,051,615 filed Mar. 14, 1996; now abandoned D-14) CAST REFRACTORY SIDE SEGMENT OF AN ANNEALING FURNACE BASE, Ser. No. 29/051,624 filed Mar. 14, 1996; now abandoned D-15) CAST REFRACTORY SIDE SEGMENT OF AN ANNEALING FURNACE BASE, Ser. No. 29/051,625 filed Mar. 14, 1996; now abandoned and, D-16) CAST REFRACTORY INNER SEGMENT OF AN ANNEALING FURNACE BASE, Ser. No. 29/051,635 filed Mar. 14, 1996, now abandoned.

The design applications designated above as "D-8)" through "D-16)" were filed as continuations-in-part not only of the utility applications designated above as "U-1)" and "U-3)," but also as continuations-in-part of the design applications designed as "D-1)" through "D-7)."

BACKGROUND OF THE INVENTION

1. Field of the Invention

The present invention relates generally to the heat treating of metal such as coils of steel in a process known as annealing. More particularly, the present invention relates to the fabrication, installation, use, maintenance, repair and replacement of annealing furnace seals and bases that preferably are formed from modular components that can be assembled on-site or very substantially assembled off-site and trucked to an installation site for being crane-lifted into position, with the modular nature of the base and seal components serving not only to facilitate component fabrication and installation, but also to permit minimal-down-time replacement of components that are damaged due to accident while in service. One example disclosed herein is off-site assembly of two "four-stack halves" of an eight-stack furnace base, with each "half" having its base structure and modular cast refractory components assembled on a separate flat-bed truck, with a special lifting fixture being used to crane-lift the resulting assemblies into place whereafter their junctures preferably are bridged by last-to-be-installed cast refractory end segments. Seals installed in the base preferably utilize an end-to-end arrangement of elongate modules of compressed, reinforced fiber refractory material that, together with spacer blocks of fiber refractory are sandwiched between upper and lower blankets of refractory fiber material, with the seals being installed in upwardly opening seal positioning troughs having cross sections that narrow with depth.

2. Prior Art

In a plural-stack annealing furnace, a fixed base structure typically having a plurality of equally spaced, centrally located charge support structures is used to support a plurality of charges of metal that are to be treated by subjecting the charges to an annealing process which typically includes a lengthy, controlled heating and controlled cool-down process in the controlled environments of a set of side-by-side treatment chambers wherein inert gas is circulated. The treatment chambers each are defined in large measure by a separate, open-bottom, tank-like inner enclosure of the furnace. Each inner enclosure is separately lowered into place about a separate one of the base-supported charges of metal, and each has a bottom rim that compressively engages a separate inner seal of the furnace which extends perimetrically about an associated one the charge support structures. Spaced outwardly from the inner seals is an outer seal that is engaged by an outer enclosure of the furnace that is lowered into seated engagement with the outer seal to heat a furnace chamber within which the inner enclosures are contained, which, in turn, transfer heat energy into the controlled environments of the treatment chambers.

Each inner seal typically is called upon not only to seal the associated treatment chamber 1) against the loss of its controlled gas atmosphere and 2) against contamination of the controlled atmosphere by leakage of ambient air into the treatment chamber, but also to physically support much, if not all, of the weight of the associated, lowered-in-place inner enclosure, the bottom rim of which is seated atop the inner seal once the inner enclosure has been lowered into place. In contrast, the while the outer seal typically is called upon 1) to prevent unwanted loss of heat energy from the furnace chamber and 2) to prevent entry into the furnace chamber of ambient air, the outer seal is seldom required to physically support much, if any, of the weight of the lowered-inplace outer enclosure of the furnace.

Sand has been widely used to form some of the inner and outer seals of annealing furnaces. While sand is desirable from the viewpoints 1) of being relatively inexpensive and 2) of being capable (if the sand happens to be distributed in a void-free and uniform manner beneath and along the entire perimeter of a depending rim of a furnace enclosure) to provide a reasonably effective seal, the use of sand in the highly active environment of a steel production facility is quite undesirable due to the fact that grains of sand are small and lightweight in character, and tend to spread themselves about the facility causing severe problems of product contamination.

Unacceptable sand contamination of steel product can result from a single grain of sand being moved out of either of an inner seal trough or an outer seal trough of an annealing furnace. For example, if a grain of sand is lifted above an annealing furnace base during the raising of one of the inner or outer enclosures of the furnace, and if the sand grain falls from the raised enclosure to become lodged in one of the many narrow spaces that may be present among adjacent wraps of a coil of steel, the errant sand grain probably will be pressed into the steel when the steel passes through the rolls of a temper mill, thereby causing an unacceptable product imperfection that, if found to be present very frequently in the output of a mill, may cause customers to purchase elsewhere.

In an effort to eliminate the use of sand seals in annealing furnaces, a wide variety of proposals have been made, some of which have made use of fiber refractory materials of various forms that are laid in place in up-wardly opening seal positioning grooves. While sand-substitute fiber seal proposals have, to some degree, been found to serve adequately to provide non-load-bearing outer seals of annealing furnaces, fiber seal proposals for use as load-bearing inner seals have inherently encountered a variety of drawbacks, chief among which has been their unduly high cost of use. Inner seals formed from refractory fiber have tended to be easily damaged during normal service use, have tended to be easily crushed under the weight of the inner enclosures that they must support, have tended to quickly lose their resilience or to otherwise quickly fail to provide gas impermeable barriers, and have, for these and other reasons, tended to require frequent replacement at unacceptably high cost.

Thus, while the desirability Of utilizing refractory fiber materials to form outer and inner seals of annealing furnaces has been recognized, a problem that has been encountered in efforts to provide sand-substitute, fiber-type inner seals—a long-standing problem that has tended to defy the finding of a suitable solution—has been the combined need to provide a fiber-type inner seal structure that will remain sufficiently resilient over a suitably lengthy service life to ensure that a gas-impervious seal of good integrity is reliably maintained, while, at the same time, offering sufficient crush resistance and structural integrity to suitably support the weight of an inner furnace enclosure.

While the desirability of utilizing costly, high technology castable refractory materials to form bases of annealing furnaces also has been recognized, efforts that have been made to mold-form these cantankerous materials in situ at the sites of an annealing furnaces have not met with good success. The type of cast refractory materials that are available at present-day that can be mold-formed to provide rigid ceramic structures that will withstand use in a steel production facility where temperatures are repeatedly cycled between ambient temperature and temperatures of up to about 1500 degrees Fahrenheit (and above) are low cement containing mixtures that include about 45 to about 47 percent alumina ($Al_2O_3$), about 45 to 47 percent silica ($SiO_2$), and that contain about 2 percent, by weight, of thin stainless steel needles (that typically are about an inch in length and are included to provide strength and reinforcement to the resulting product)—which are mixed with a sufficiently small quantity of water to barely bring the material to a dry granular consistency that can be fed into a mold without causing a cloud of dust to arise as the mix is fed into the mold, and which require the presence of power-induced mold vibration in order to ensure that the material is properly distributed throughout the mold to form a mixture of even consistency that can be cured to form a strong, temperature-cycle-resistant product.

To achieve the uniformity and high density of refractory material that is needed in the resulting product, it is important that the water content of a cast refractory mix be carefully controlled and kept to a minimum, that the vibration that is applied to the mold be sufficiently powerful to thoroughly vibrate the mold for substantially the entire period of time that the mold is being filled, and that the newly molded product be carefully cured in a temperature controlled environment—little, if any, of which tends to be properly carried out if what one tries to do is to mold an annealing furnace base in situ at a furnace site.

Forming cast refractory members to provide components of annealing furnace bases has even proved to be a difficult undertaking to carry out in a specialized cast refractory production facility due to the enormous size and weight of the members that need to be formed, and due to the massive amounts of cast refractory material that need to be aggressively vibrated into place in massive molds or forms. If base components are made that are too small in size, the number of components that must be installed, the nature of the mistakes that can be made in installing components, and problems of component breakage unduly complicate the work of effecting full-base replacements. On the other hand, the larger that components are made, the heavier they are to move, the more difficult they are to properly position, and the less forgiving they are of accommodating dimensional irregularities that are encountered to some degree in almost every base replacement endeavor. Finding a "right approach" to the sizing and shaping of remote-facility-molded cast refractory segments for annealing furnace bases has proved to be elusive.

While efforts have been made to mold whole furnace bases and base portions off-site at facilities that specialize in the fabrication of mold-formed castable refractory structures by mold-forming castable refractory materials, such efforts have met with very differing degrees of success depending often on the extent to which success can be had in transporting the resulting structures to, and in crane-lifting such structures into place at, a furnace site. Trying to use lift truck forks to maneuver cast refractory structures, and trying to lift and position cast refractory structures utilizing crane-supported cables that wrap about or otherwise engage outer surfaces of the newly molded cast refractory structures tends to cause unacceptable chipping, cracking and breakage. Moreover, incorrectly stressing or inadequately supporting these massively heavy cast structures during transport or during lifting or positioning, can easily cause the newly cast structures crack and/or to break apart under their own weight.

Thus, while the desirability of forming cast refractory annealing furnace bases has been recognized, the need for a practical method that will actually enable cast refractory bases of high structural integrity and offering reliably good performance characteristics to be provided and installed with excellent consistency has gone unfulfilled.

Another problem that has been encountered with annealing furnace bases is the severe warping and cracking of, and hence the need for frequent replacement of, structural steel that typically is welded in place in the vicinities of the inner or outer seals of the furnace. Inner walls of the outer seal troughs of annealing furnaces have, for example, typically been formed from structural steel that is held in place by virtue of being welded to an underlying base support structure of the furnace, and this structural steel often is found to warp severely and to break loose from its welds long before the service life of an adjacent cast ceramic base has come to a close.

Because structural steel does not fare well when subjected to repeated cycling between ambient temperature and elevated temperatures within the range of about 1500 degrees Fahrenheit (and above), and because welds of structural steel also perform poorly when subjected to repeated temperature cycles of this type, it has been recognized as being desirable to eliminate or minimize the use of structural steel and structural steel welds in the vicinities of the inner and outer seals of annealing furnaces. However, it has been widely accepted that cast refractory materials do not have sufficient strength and sufficient impact resistance to be used either in place of such structural steel or in reinforcing welded steel structures that may need to be used to define the outer seal trough of an annealing furnace.

Because the base structures of annealing furnaces are subjected to repeated cycles of high temperature heating followed by cooling, and because heavy loads are imposed on these structures as both massive charges of metal and heavy furnace enclosures are moved into and out of position, annealing furnace base structures need to be serviced and repaired frequently, and replaced regularly as a part of scheduled programs of maintenance—which is true regardless of the character of the materials from which the bases are formed.

Plural-stack annealing furnace bases are so large in size and so heavy in weight that it has long been considered impractical, if not impossible, to assemble these structures at a remote facility, and to then transfer the assembled structures to, and install the assembled structures at, a plural-stack furnace site. Especially if sizable cast refractory components are utilized in forming a plural-stack base, it essentially has been "accepted" that the size and weight of an assembled plural-stack base, combined with the minimal capability that cast refractory components have to withstand deformation, prohibits the assembly at and transfer from a remote facility of a plural-stack annealing furnace base that can be installed as an assembled, ready-to-operate unit. Accordingly, replacement of plural-stack annealing furnace bases has tended to consume sizable amounts of furnace "down time" due the perceived "requirement" that base assembly be carried out in situ at the furnace site.

Far too much "down time" has been needed to maintain, repair and replace the bases of plural-stack annealing furnaces. Improved base structures, and improved base maintenance, repair and replacement tools and techniques have been needed that permit the maintenance, repair and replacement of annealing furnace bases to be carried out with much less "down time."

3. The Referenced Cases

The several design cases referred to above by the designations "D-1)" through "D-16)" disclose a number of cast refractory base segment configurations and arrangements that can be used in conjunction with single-stack and/or plural-stack annealing furnaces.

The utility applications referred to above by the designations "U-1)"and "U-2)" relate generally to single-stack annealing furnace base fabrication, installation, use, maintenance, repair and replacement (and are referred to hereinafter as the "single-stack cases"). The utility applications referred to above by the designations "U-3)" and "U-4)" relate generally to plural-stack annealing furnace base fabrication, installation, use, maintenance, repair and replacement (and are referred to hereinafter as the "plural-stack cases"). Furnace base installations that embody the inventions of the referenced single-stack and plural-stack cases are characterized by excellent longevity of service, by reliable and lengthy inner seal performance, and by the utilization of modular components that can be maintained, repaired and eventually replaced with relative ease and convenience, and with minimal furnace "down time."

A significant aspect of the preferred practice of the inventions of the referenced single-stack and plural-stack cases relates to the provision of a set of cast refractory and modular fiber seal components for an annealing furnace base that lend themselves quite nicely to either of two modes of base assembly: namely, 1) to being transported to a furnace site in modular form (i.e., as a set of unassembled components for being assembled at the furnace site, or 2) to being substantially fully assembled to form a furnace base at a remote, "off-site" location, and then being transported to and final-positioned at a furnace site in assembled form.

If on-site assembly is elected, such portions of an existing welded steel base support structure of an annealing furnace as may need to be repaired or replaced are attended to, or a new welded steel base support structure is provided and is lifted into position. Atop the base support structure, an initial blanket of refractory fiber material is laid in place; cast refractory segments of the new base are installed side by side atop the initial blanket; and a novel set of inner seal components that embody features of the invention is installed in inner seal positioning troughs of tapered cross-section that are defined between inner and outer segments of the cast refractory base, as will be described later herein. Methods by which an annealing furnace base preferably is assembled and installed on-site utilizing a novel set of modular components also constitute features of the invention of the referenced single-stack and plural-stack cases.

If off-site assembly is elected, a new welded steel base support structure is provided; an initial blanket of fiber refractory together with cast refractory segments and the novel modular-segment inner seal assembly are installed; and the assembled base is trucked to the furnace site to be lifted in place as soon as an existing base and its debris are cleared away. If off-site assembly is utilized, the new base support structure preferably is provided with upstanding lift connection arms that are strategically located to permit the assembled base to be lifted from a transport vehicle and final positioned at the installation site without causing damage to the assembled segments—whereafter the upstanding arms can be cut off utilizing a cutting torch, If desired. Tools and techniques that preferably are employed when a furnace base is assembled off-site utilizing modular components, and is lifted from a truck and installed at a furnace site also constitute features of the invention of the referenced single-stack and plural-stack cases A significant feature of the preferred practice of the inventions of the referenced single-stack and plural-stack cases has to do with the provision of a novel set of elongate fiber seal modules of compressed, reinforced fiber refractory material that preferably are utilized in combination with a set of spacer blocks of fiber refractory material and a pair of elongate blankets of fiber refractory material to form at least the inner seals of the base of a single-stack or a plural-stack an annealing furnace, it being understood that the outer seal of the furnace also can be formed utilizing substantially the same components. The use of compressed, reinforced fiber refractory modules together with other fiber refractory components to form inner seals that will retain needed resilience during a lengthy service life while also providing a capability to properly support the heavy inner enclosures of the furnace represents a significant advance in the art.

Another feature of preferred practice of the inventions of the referenced single-stack and plural-stack cases has to do with techniques that are used to tightly pack the novel fiber seal modules end-to-end and downwardly into the upwardly opening inner seal positioning troughs that are defined between the inner and outer cast refractory base segments to form particularly effective inner seals that have been found to perform exceptionally well during suitably lengthy service lives. Tests have shown that a typical inner seal formed in accordance with the preferred practice of the present invention will permit an inert gas pressure of 5 ounces per square inch (above ambient air pressure) to be maintained in a treatment chamber—which is about five times the gas pressure that typically has been reliably attainable and maintainable with previously proposed seals that make use of some form of fiber refractory. The seal installation techniques that have been developed that permit use of compressed, reinforced fiber modules together with spacer blocks and a set of upper and lower blankets of fiber refractory to define a much improved seal also represent a significant step forward in the art.

Still another feature relates to techniques and tools that preferably are utilized to maintain and rejuvenate the fiber seal assemblies of a plural-stack base to ensure that the seal assemblies perform well during the course of lengthy service lives. In preferred practice, each of the trough-carried, tightly packed, end-to-end arrangements of fiber seal modules is sandwiched between an overlying upper blanket of fiber refractory material, and an underlying lower blanket of refractory fiber material, with the upper blanket being replaced from time to time as part of an ongoing program of scheduled maintenance. The seal is rejuvenated from time to time by utilizing a special compression and shaping tool that simultaneously engages the full circumferential length of the upwardly facing surface of the seal 1) to press-shape the top surface of the seal, and 2) to ensure that all components of the seal are properly pressed down into the enclosing trough so that the seal will properly receive and make sealing engagement with the bottom rim of an inner enclosure when an inner enclosure is lowered into seated engagement with the seal.

The seal compression and shaping tool also is used beneficially during seal installation, repair and replacement. Fiber seal installation, rejuvenation, maintenance and replacement techniques that preferably are utilized to achieve good fiber seal performance and to maintain good seal performance throughout a lengthy service life also constitute aspects of the present invention.

In accordance with another feature of preferred practice of the inventions of the referenced single-stack and plural-stack cases, a furnace base is provided with one or more upwardly opening inner seal positioning troughs, each having a cross-section that narrows with trough depth, with the troughs being defined between inner and outer members of a novel set of cast refractory segments that form a rigid ceramic refractory base of the furnace. Inner segments of the cast refractory base define one of two opposed sides of each of the inner seal positioning troughs; outer segments define the other; and the segment surfaces that define opposite sides of each trough preferably provide trough cross-sections that narrow with depth to assist in maintaining a tight fit with refractory fiber components of the inner seals as these components tend to be pressed downwardly into the troughs by the weight of inner enclosures of the furnace seated atop the inner seals. The use of a set of inner and outer cast refractory segments to define tapered inner seal positioning troughs that aid in keeping the inner seals tightly in place in the troughs throughout their service lives also constitutes a significant feature of preferred practice.

Another aspect of preferred practice relates to the provision of a plural-stack annealing furnace base that utilizes a novel set of inner and outer cast refractory segments to form a rigid ceramic refractory base, with at least selected ones of the outer segments of the base having hard, wear and impact resistant, pre-cast refractory inserts integrally anchored to adjacent portions of the cast refractory outer segments for defining furnace-enclosure engageable surfaces that will withstand the sometimes base-damaging types of contacts and impacts that normally are encountered during furnace enclosure movements.

Still another feature resides in the ease with which the base design 1) can be adapted to accommodate the use of conventional structural steel adjacent the location of the outer seal of the base, or 2) can substitute for conventional structural steel improved cast refractory outer base components that have hard, wear and impact resistant, pre-cast ceramic "inserts" for bordering the inside surface of an outer seal groove to be engaged by a furnace enclosure that is being positioned for use, that are integrally connected to the outer base components at the time the outer base components are mold formed, and that provide needed outer seal border structure that will serve the required function without warping, cracking and otherwise experiencing the significant kinds of problems that are encountered with the use of a structural steel outer seal border. Methods of forming outer segments of a plural-stack base assembly to incorporate hard, wear and impact resistant, pre-cast ceramic inserts also comprise aspects of the preferred practice of the present invention.

Still another feature resides in the provision of a base assembly design that easily can be adapted for use with either conventional outer seals that typically are formed using sand, or that can incorporate steel structure that is anchored to cast refractory outer segments when these segments are mold-formed, with the refractory anchored steel structure defining an outer seal groove for mounting a compressed, fiber refractory outer seal formed from modules in substantially the same manner that the above-described inner seal is formed. Methods of fabricating and assembling cast refractory outer segments that have steel structure anchored thereto for defining an outer seal groove, and of utilizing compressed refractory fiber modules in conjunction with outer cast refractory sections to form an outer seal of a plural-stack base assembly also constitute aspects of the present invention.

In accordance with still another Feature, installation, removal and replacement of the cast refractory segments is facilitated by providing each and every one of the cast refractory segments with three lift engageable formations that are anchored securely into the cast refractory material of each segment, and that can be connected to a three-armed lifting fixture that is designed to support the cast refractory segments in horizontally extending attitudes as the segments are positioned and installed with the aid of a crane. This combination of a triumvirate of segment-anchored lift connections and the use of a three-arm lifting fixture obviates the need to wrap cables about, or to otherwise bring lifting devices directly into contact with outer surfaces of cast refractory segments, and provides a means by which segments can be final positioned without having to b pried into place or otherwise man-handled in ways that might detrimentally affect the integrity of the cast segments.

Another aspect of the preferred practice of the inventions of the referenced plural-stack cases relates to the provision of a plural-stack base assembly that is comprised of components which permit a complete base unit to be remotely assembled atop the flat bed of a transport truck in a facility that may not have crane capacity that is sufficient to lift more than the weight of the heaviest major component that is utilized in forming the assembled base. A further aspect has to do with a preferred form of lifting fixture that permits a massively heavy, fully assembled plural-stack base to be lifted from a flat bed truck and put into place at a steel mill where heavy crane lift capacity normally is present. Methods by which modular base segments are assembled at a remote facility that may have only limited crane lift capacity, and are transported to and installed at a furnace site utilizing a transport vehicle on which a base unit has been assembled also constitute aspects of the invention of the referenced plural-stack cases.

SUMMARY OF THE INVENTION

Invention features that are disclosed in the present application share a great deal in common with such features as are disclosed in the above-referenced single-stack and plural-stack cases. Accordingly, much of what is set out in the foregoing section (wherein features of the referenced single-stack and plural-stack cases are described) is equally applicable to invention features that are described and claimed herein.

One purpose of the present case is to describe how, with very little modification, features of the referenced single-stack and plural-stack cases can be applied to plural-stack annealing furnaces of a type that employ plural, parallel-extending rows of stacks (i.e., stacks that are not all aligned in a common row, which is the arrangement that is disclosed in the referenced plural-stack cases). For example, while the referenced plural-stack cases describe "four-stack, aligned in a single row" base embodiments each can be built on a single flat-bed truck at a site remote from a furnace location where the base is to be installed, the present case discloses how four-stack "base halves" for "eight-stack, two-row" base embodiments can be assembled at a remote site with each four-stack "half" being built atop a separate flat-bed truck—with the resulting "base half assemblies" being crane-lifted into installed side-by-side positions after being trucked to a furnace site that needs an eight-stack base replaced with a minimum of "down time." Some claims are included herein that will be found to be generic to one or more of the several single-stack and/or plural-stack arrangements that are disclosed in the present and above-referenced utility cases.

Another purpose of the present case is to present additional claims directed to features that are disclosed in one or more of the above-referenced single-stack and plural-stack cases—features that have come to be better understood as finding significant utility not only in such combinations as are claimed in the referenced single-stack and plural-stack cases but also in other combinations and when used independently. For example, features of the novel form of modular-component seals that are disclosed in the referenced single-stack and plural-stack cases have been found to be usable to significant advantage in a variety of furnace environments that do not also employ the type of modular cast refractory segments that also are disclosed. Likewise, the novel cast refractory base segments disclosed in the referenced single-stack and plural-stack cases have been found to be usable to significant advantage in furnace environments that do not necessarily employ the disclosed type of modular seal components.

A feature that, in accordance with the present invention preferably is utilized in annealing furnace bases of the type that employ side-by-side rows of stacks, has to do with a novel combination of inner, outer and center cast refractory segments, each of which is designed to be individually lifted in place during base assembly—which represents an expanded use of features that were disclosed in the referenced single-stack and plural-stack cases. Other features that also originate with the above-referenced cases are expanded upon in the disclosure that follows.

BRIEF DESCRIPTION OF THE DRAWINGS

Other features and a fuller understanding of the invention may be had by referring to the following description and claims taken in conjunction with the accompanying drawings, wherein:

FIG. 5 is a perspective view, on an enlarged scale, illustrating somewhat schematically, how, cube-shaped blocks of refractory fiber insulation can be cut from a log of refractory fiber insulation for use in forming fiber seal modules;

FIG. 6 is an exploded perspective view depicting selected components of a fiber seal module of the type that preferably is utilized form at least the inner seals that are employed in plural-stack annealing furnace bases in accordance with the preferred practice of the present invention;

FIG. 7 is a perspective view of an assembled one of the fiber seal modules;

FIG. 8 is an exploded perspective view illustrating fiber seal modules, spacer blocks and a pair of upper and lower blankets of refractory fiber insulation that preferably are utilized in forming inner seals in plural-stack annealing furnace bases;

DESCRIPTION OF THE PREFERRED EMBODIMENT

Figure 1:
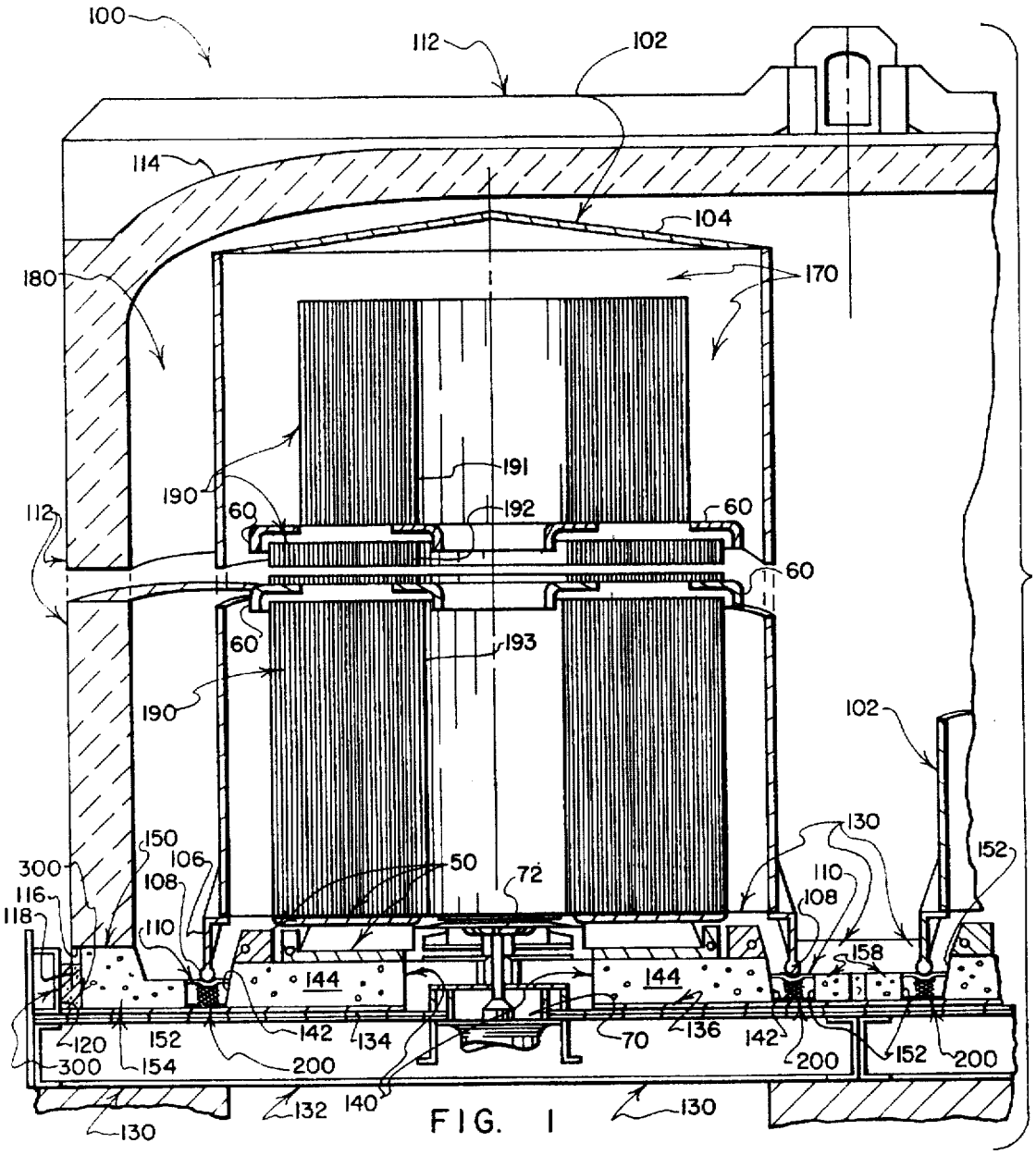
FIG. 1 is a foreshortened vertical cross-sectional view depicting portions of a typical stack of a plural-stack annealing furnace that has cast refractory base segments and a modular fiber seal system forming an inner seal that embody features of the preferred practice of the present invention, with the view also showing lower portions of an adjacent identical stack.
Figure 3:
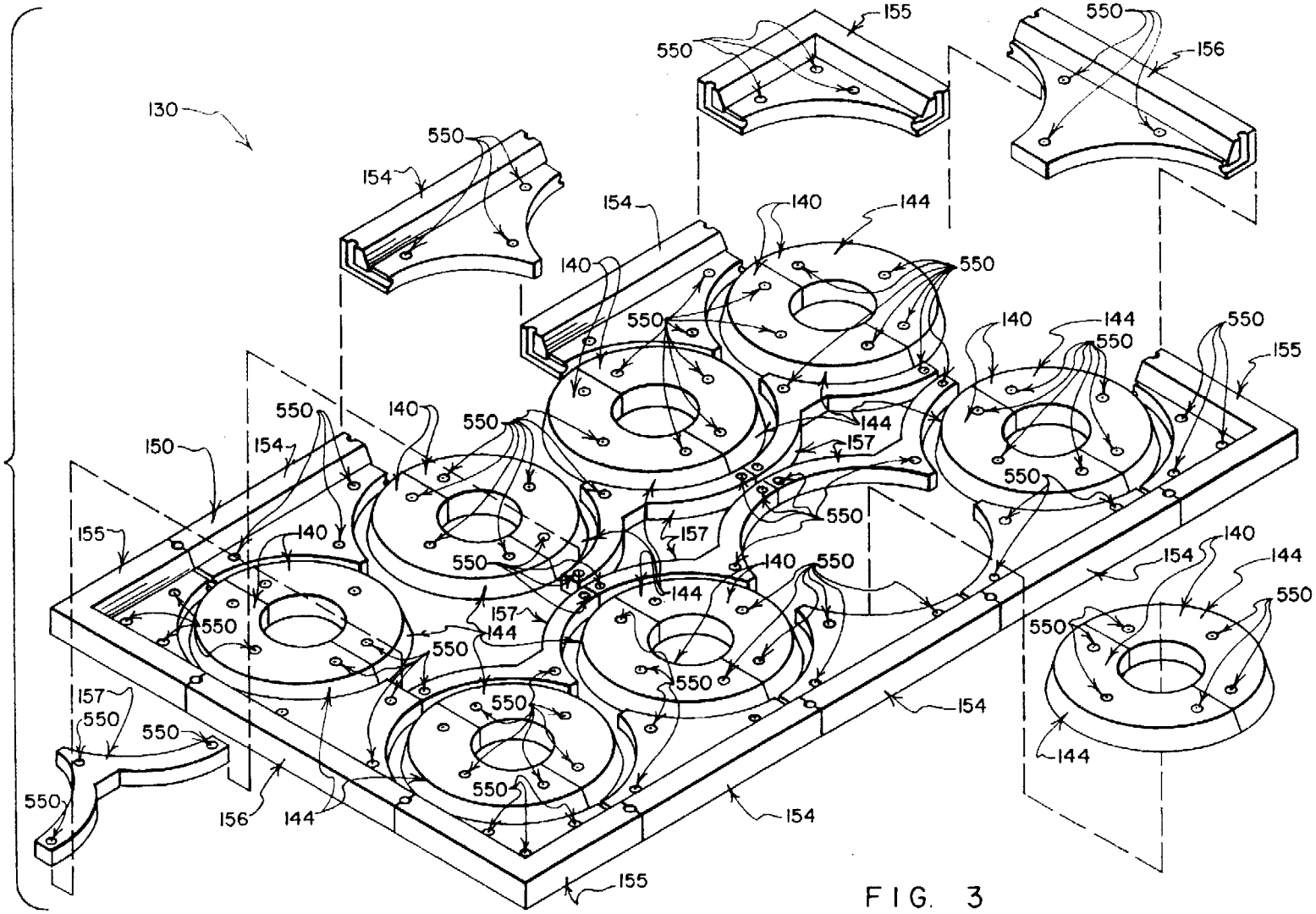
FIG. 3 is a perspective view depicting an eight-stack array of inner, outer and central cast refractory base segments utilized in the base of the furnace of FIG. 1, with some of the segments shown removed front the array to permit selected features to be better viewed.

Referring to FIG. 1, an annealing furnace that incorporates novel and improved base features representing the preferred practice of the present invention is indicated generally by the numeral 100. The furnace 101 is of the "plural-stack" type that employs two parallel rows of side-by-side stacks. More particularly, the furnace 100 is an eight-stack furnace that has parallel-extending rows each containing four stacks, wherein each of the four stacks of one row is paired side-by-side with a separate one of the four stacks of the other row—as is depicted in FIG. 3.

In the sectional view of FIG. 1, major portions of a left-row stack are shown, but only minor lower portions of its associated right-row stack are shown—it being understood that the right-row stack has a cross section that is essentially a mirror image reversal of the left-row stack. Each of the eight stacks is served by a common base structure, features of which will be described in greater detail shortly. Each of the stacks has a separate, removable, generally cylindrical, downwardly-opening inner enclosure (or "inner cover") of the type that is shown in cross-section and is indicated generally by the reference numeral 102 in FIG. 1. A much larger, generally rectangular, removable outer enclosure 112 (or "outer cover"—left portions of which are shown in cross-section in FIG. 1) is provided to surround all of the closely spaced inner enclosures 102.

Figure 4:
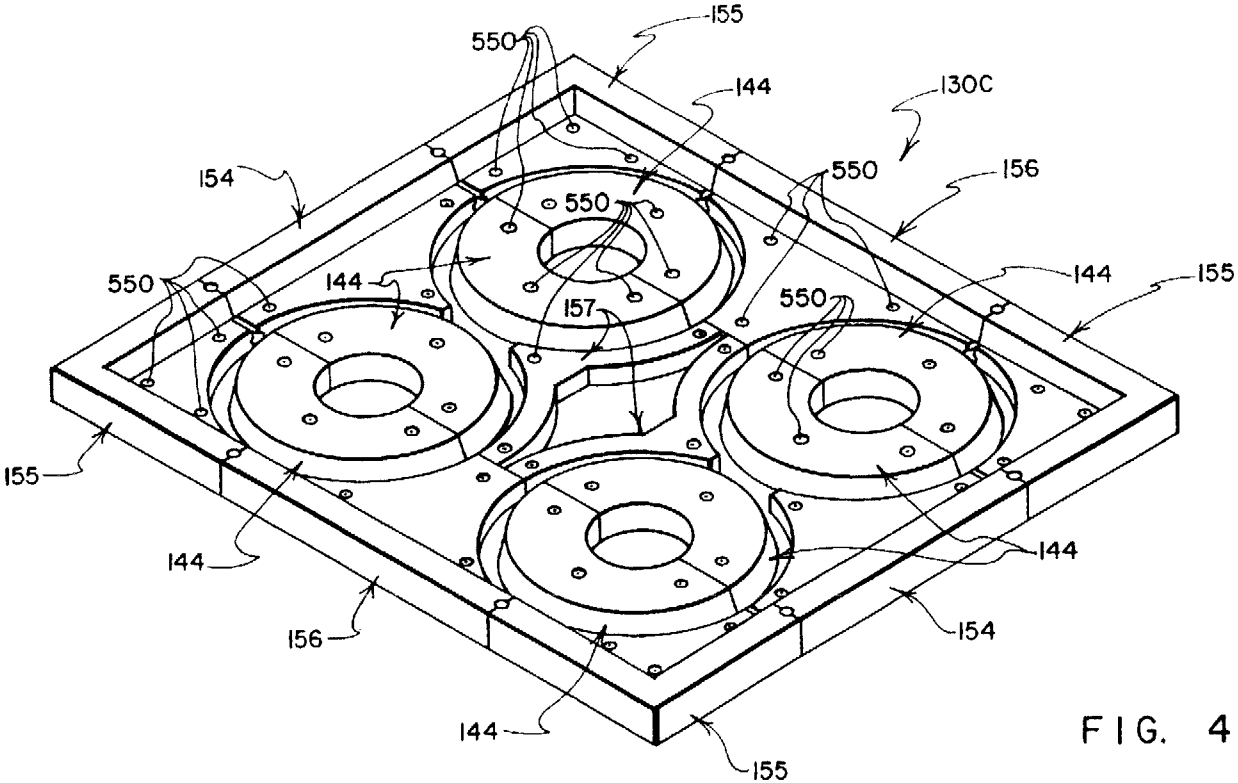
FIG. 4 is a perspective view depicting a four-stack array formed using selected ones of the inner, outer and central base segments from the eight-stack array of FIG. 3.

While features of an eight-stack annealing furnace base are described and depicted herein, it will be understood that features of the invention are not limited to use with annealing furnaces having precisely eight stacks arranged in two side-by-side rows. In FIG. 4, for example, selected ones of the cast refractory base segments that are used in the eight-stack base array 130 of FIG. 3 are shown forming a four-stack base array 130C.

Except for the novel and improved base features that will be described shortly, the furnace 100 preferably is of the general type that has its structure and operation described in detail in the following patents of Gary L. Coble, referred to hereinafter as the "Annealing Furnace Patents," the disclosures of which are incorporated herein by reference, namely: 1) DIFFUSER SYSTEM FOR ANNEALING FURNACE, U.S. Pat. No. 4,516,758 issued May 14, 1985; 2) DIFFUSER SYSTEM FOR ANNEALING FURNACE WITH WATER COOLED BASE, U.S. Pat. No. 4,611,791 issued Sep. 16, 1986; 3) METHOD OF ANNEALING USING DIFFUSER SYSTEM FOR ANNEALING FURNACE WITH WATER COOLED BASE, U.S. Pat. No. 4,755,236 issued Jul. 5, 1988; and, 4) DIFFUSER SYSTEM FOR ANNEALING FURNACE WITH CHAIN REINFORCED, MODULAR IRON CONVECTOR PLATES, U.S. Pat. No. 5,048,802 issued Sep. 17, 1991.

While the furnace 100 will be understood to provide a plurality of stacks, the stacks are arranged closely side by side in two "in-line rows,"and all have substantially the same appearance when viewed in cross-section (except that furnace features associated with the "right" row of stacks have cross-sectional appearances that are, in essence, mirror images of corresponding features from the "left" row of stacks. For this reason, the cross-sectional view that is presented by FIG. 1 and which shows major portions of only one of the stacks of the furnace 100 represents a "typical" annealing furnace stack, and the description presented herein of the features of the one depicted stack is largely applicable to the other stacks of the furnace 100.

Referring to FIG. 1, the furnace 100 includes a conventional, generally cylindrical inner enclosure 102 that is surrounded by a generally rectangular outer enclosure 112. The enclosures 102, 112 have closed upper ends 104, 114 and open lower ends 106, 116, respectively,. The inner enclosure 102 has a depending rim formation 108 that extends into an upwardly opening inner seal trough 110. The outer enclosure 112 has a depending knife edge formation 118 that extends into an upwardly opening outer seal trough 120.

Figure 2:
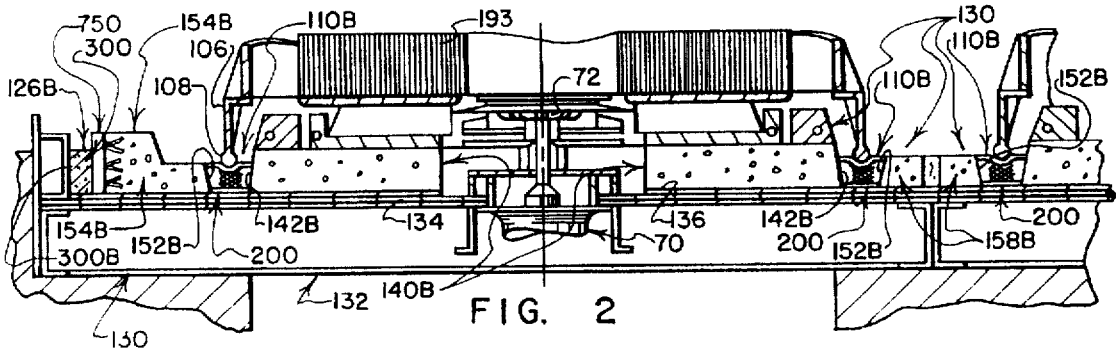
FIG. 2 is a vertical cross-sectional view similar to FIG. 1 showing features of an alternate form of base that embodies features of the present invention, with lower portions of an adjacent identical stack also being shown.
Figure 13:
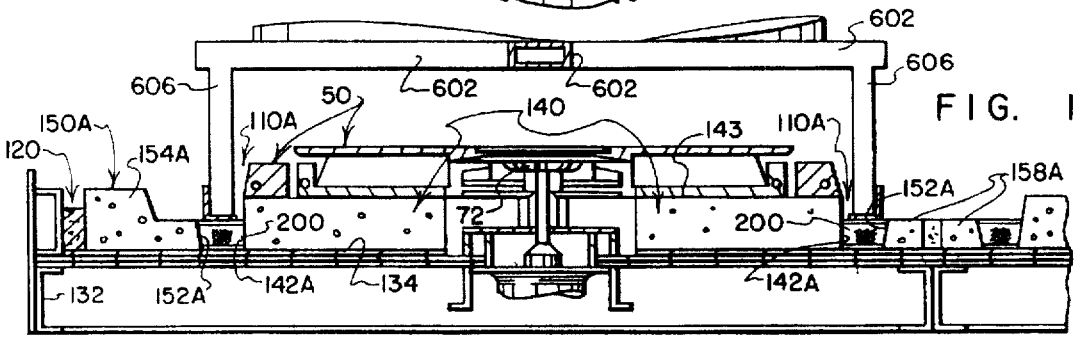
FIG. 13 is a sectional view that shows features of an alternate form of base that embodies features of the present invention, with the tool of FIG. 11 seated atop the inner seal of the base.

Also disclosed herein are two alternate forms of annealing furnace bases that illustrate modifications that can be selectively utilized, as desired. In FIGS. 13 and 2, furnace bases 300A, 300B, respectively, are depicted that utilize different arrangements of cast refractory surfaces (than is utilized in the furnace base 300 of FIGS. 1 and 3) to provide inner seal troughs 110A, 110B, respectively, that narrow with depth Also, the furnace base embodiment 300B depicted in FIG. 2 employs hard, wear and impact resistant, pre-cast ceramic refractory inserts 750 (one of which is depicted in cross-section in FIG. 2) that are anchored to the cast refractory material from which outer segments 150B of the cast refractory base 130B are formed to provide a durable refractory border for an outer seal trough 120B.

Because the furnace bases 130 (depicted in FIGS. 1 and 3), 130A (depicted in FIG. 13), 130B (depicted in FIG. 2), and 130C (depicted in FIG. 4), respectively, have much in common, a system of similar reference numerals is utilized in the drawings to depict similar features. Reference numerals that are "Identical" are utilized in FIGS. 1–4 and 13 to designate features and components that are "identical. " Components of the base 130A shown in FIG. 13 that differ a bit in configuration from the components of the base 130 shown in FIGS. 1 and 3 are indicated by reference numerals that "correspond" to those used in FIGS. 1 and 3 except for the addition thereto of the letter "A." Components of the base 130B shown in FIG. 2 that differ a bit in configuration from the components of the base 130 shown in FIGS. 1 and 3 are indicated by reference numerals that "correspond" to those used in FIGS. 1 and 3 except for the addition thereto of the letter "B." Since the base segment array depicted in FIG. 4 uses only selected components that are identical to those depicted in FIG. 3, these identical components are indicated by identical numerals in FIGS. 3 and 4.

Returning to FIG. 1, the inner seal trough 110 contains an inner seal 200 that, together with the inner trough 110, extend substantially concentrically about a generally circular, cast refractory "inner base structure" 140. As is best seen in FIG. 3, the inner base structure 140 that underlies each of the four stacks of the furnace 100 comprises a set of two generally C-shaped cast refractory "inner segments" 144. In preferred practice, all sixteen of the C-shaped inner segments 144 utilized in forming all eight of the inner base structures 140 are identical one with another, and are therefore interchangeable. When each pair of the C-shaped inner segments 144 are positioned side by side to form one of the inner structures 140 of one of the stacks of the furnace 100, such narrow space as may remain open between adjacent opposite ends of the segments 144 of each of the sets 140 preferably are filled with refractory mortar (not shown) so that the resulting inner base structures 140 extend endlessly and continuously in ring-like, annular form.

The outer seal trough 120 contains an outer seal 300 that, together with the trough 120 extends about the generally rectangular perimeter of the an "outer base structure" 150. Referring to FIG. 3, the outer base structure 150 that extends about the inner structures 140, in spaced relationship thereto, comprises a set that includes "side" segments 154, "corner" segments 155, "end" segments 156, and "center" segments 157. Six side segments 154 are employed that are identical one with another, and are therefore interchangeable. Four corner segments 155 are employed that are identical one with another, and are therefore interchangeable. Two end segments 156 are employed that are identical one with another, and are therefore interchangeable. Six center segments 157 are employed that are identical one with another, and are therefore interchangeable.

The corner segments 155 are deployed in pairs at opposite ends of the outer base structure 150. The side segments 154 are deployed in a group situated between the two pairs of corner segments 155. The end segments 156 each extend between a separate pair of the corner segments 155. The center segments 157 are employed in pairs to extend in two side-by-side rows between the end segments 157. Such narrow spaces as may remain open between adjacent surfaces of the paired center segments 144 and between adjacent pairs of the various other segments 154, 156 and 157 preferably are filled with refractory mortar (not shown) so that the resulting outer base stricture 150 extends endlessly and continuously to ring each of the eight sets of continuously-extending inner structures 140.

Referring to FIGS. 13 and 2, cast refractory segments of the furnace bases 130A and 130B include center segments 144A and 144B, side segments 154A and 154B, and center segments 158A and 158B that cooperate to define therebetween inner seal troughs 110A, 110B, respectively, in much the same manner that the inner, side and center segments 144, 154, 158 of the furnace base 130 define opposite sides of the inner seal troughs 110, as is depicted in FIG. 1. However, a difference between the furnace bases 130, 130A and 130B that is appropriate to point out at this stage of the description has to do with the manner in which these various furnace bases provide inner seal troughs 110, 110A, 110B that taper to increase in width as they open upwardly (and hence to decrease in width with increased trough depth). In the furnace base 130 of FIGS. 1 and 3, the side and center segments 154, 158 (located on opposite sides of the inner structure 140) define vertically extending surfaces 152 that form one side of the trough 110, with the inner segments 144 having inclined sides 142 that cause the trough 110 to increase in width as it opens upwardly (and hence to decrease in width with increased trough depth). In the furnace base 130A of FIG. 13, the inner side surfaces 142A defined by the inner segments 144A are vertical, and side and center segments 154A, 158A define inclined trough sides 152A that provide the trough 110A with a cross-section that widens as it opens upwardly (and hence to decrease in width with increased trough depth). In the furnace base 130B of FIG. 2, all of the trough sides 142B, 152B are inclined to provide the trough 110B with a cross-section that widens as it opens upwardly (and hence to decrease in width with increased trough depth).

Returning to FIG. 1, the base structure 130 includes an arrangement of welded steel components that includes one or more generally horizontally extending steel plates 134 that underlie and support the inner and outer base structures 140, 150. If the base structure 130 is formed in two parts or "halves" 132 that each serve one of the four-stack rows of the furnace 100, each "half" 132 has its own steel plate(s) underlying and supporting its associated inner and outer base structures 140, 150. It is quite important that each of the plates 134 be substantially flat, and that the plate 134 be of good integrity. If the base structure 130 of an existing furnace is being rebuilt, it often will be necessary to replace its plate or plates 134 to ensure that the cast refractory components that will be supported by the plate 134(s) will be properly supported and aligned side-by-side throughout their service life.

Figure 19:
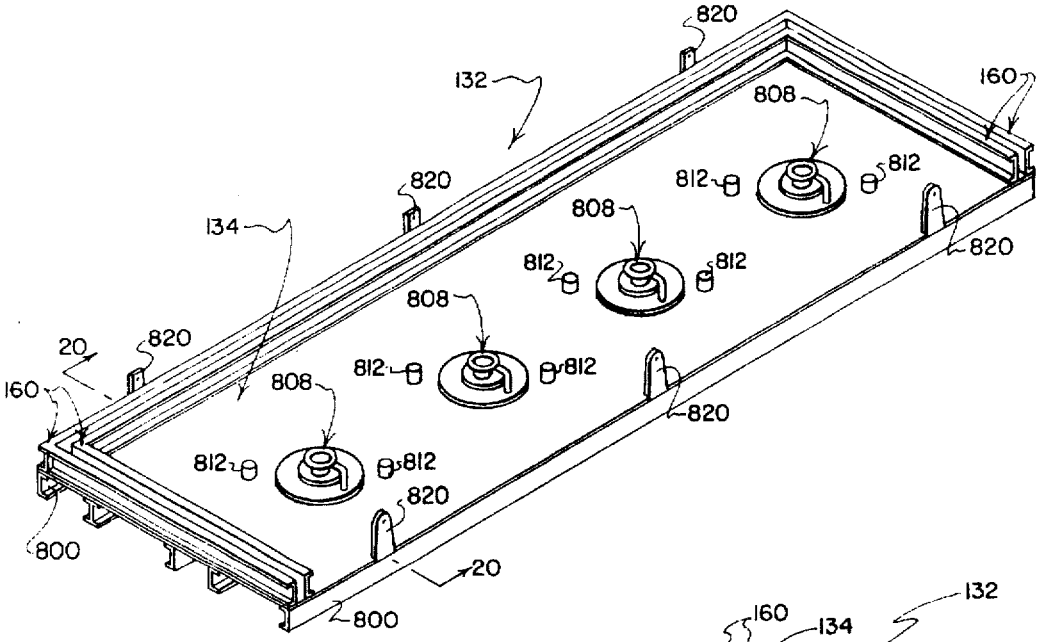
FIG. 19 is a perspective view showing principally top, front and left end portions of a welded steel base support structure "half" configured to support cast refractory segments of a "four-stack row" of the eight-stack furnace of FIGS. 1 and 3, which Wan be fabricated off-site from the location of the furnace.
Figure 20:
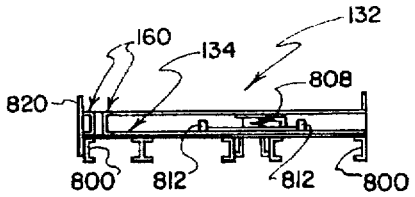
FIG. 20 is a sectional view thereof, as seen from a plane indicated by a line 20—20 in FIG. 19.
Figure 21:
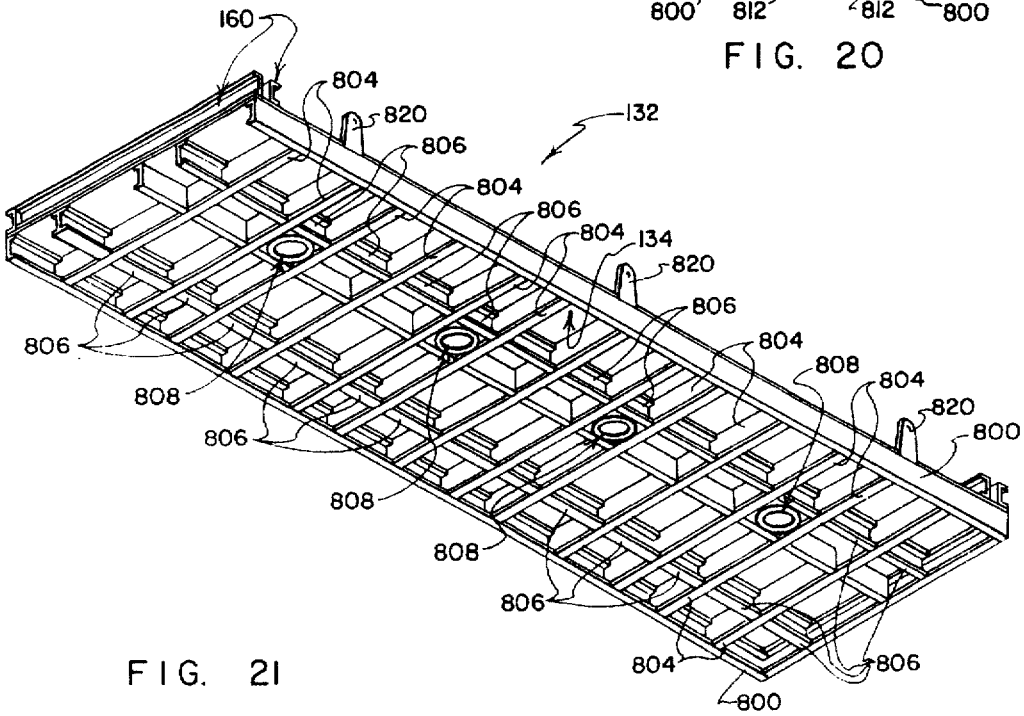
FIG. 21 is a perspective view showing principally bottom, front and left end portions of the base support structure "half" of FIG. 19.

Referring to FIGS. 19–21 (wherein a typical four-stack base structure "half" 132 is depicted, it being understood that the other four-stack "half" of the base 130 is formed by similar structure that essentially is a mirror image of the depicted base structure "half" 132), if a new base support structure 130 is to be provided for an existing furnace, a typical one of its "halves" preferably will include a pair of widely spaced, relatively large structural steel members 800 that extend along opposite side portions of the structure 132 between opposite ends thereof; a plurality of smaller structural steel members 804 that extend transversely between the I-beams 800 at spaced locations along the length of the structure 132; and other bracing and support members 806, as needed, to bridge between the transversely extending beams 804.

For a four-stack base "half" 132, the plate 134 will have four relatively large openings formed therethrough, through which suitable dome shaped enclosures 808 are provided to define four substantially equally spaced blower mount locations. Where pipe segments need to extend through the plate 134 (e.g., for such purposes as the feeding of gas to and/or from the environment of the treatment chamber 170, etc.), pipe segments 812 are inserted through appropriately positioned holes in the plate 134 and are welded to the plate 134.

Figure 24:
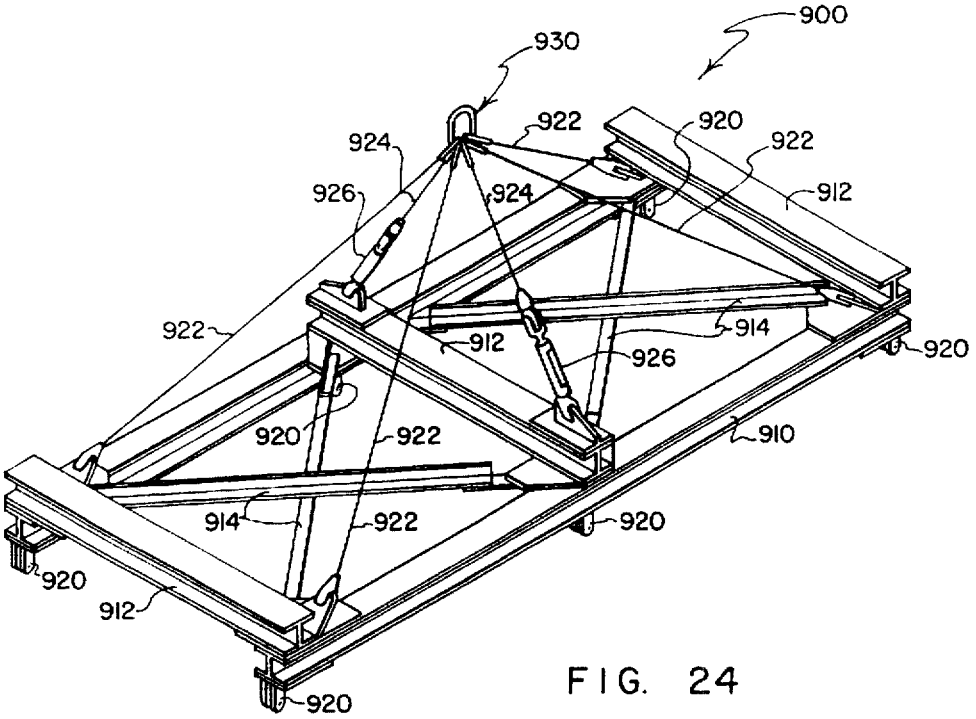
FIG. 24 is a perspective view depicting a six-connection, crane-supportable lifting fixture that preferably is utilized to connect an assembled base "half" to a crane during removal of the assembled base "half" from the truck bed for installation at a furnace site; and, FIG. 25 is a side elevational view depicting the lifting fixture of FIG. 25 connected to an assembled base "half" as the base "half" is lowered into position at a furnace site.
Figure 25:
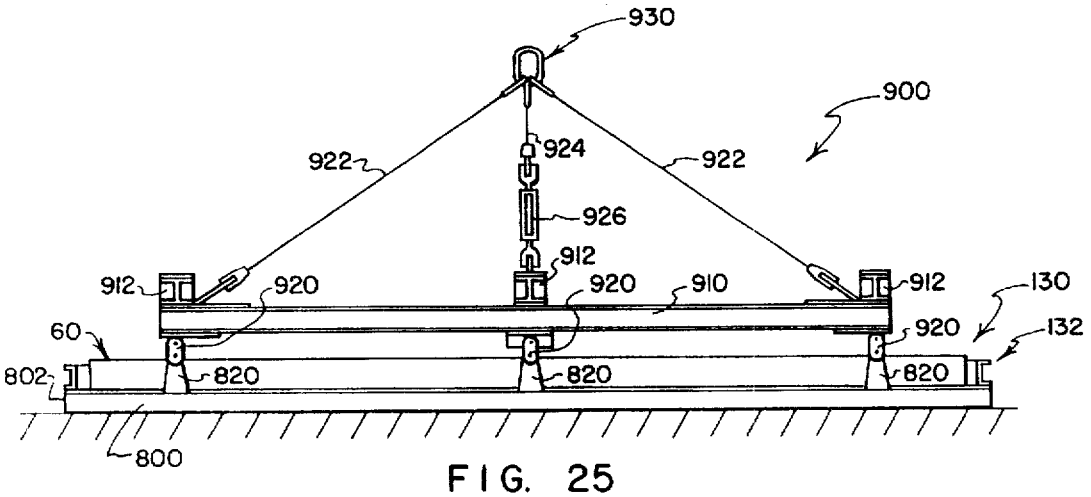

Continuing to refer to FIGS. 19–21, the steel members 160 that define opposite sides of the outer seal trough 120 are welded atop the plate 134 and extend along perimeter portions of the plate 134. Extending upwardly from, and welded securely to opposite sides of the base "half" structure 132 at spaced locations along the opposite sides thereof, are six lift connection arms 820 that can be removably connected to a special six-connection lift fixture 900 that is depicted in FIGS. 24 and 25. When the six connection points 920 of the lift fixture 900 are connected to the lift arms 820, the base "half" structure 132 can be moved about by a crane (not shown) that is connected to a central cable connector 920 of the fixture 900. Once the base support structure 132 has been put in its final position at a furnace site, the lift arms 820 can be cut away utilizing a cutting torch (not shown) to ensure that the lift connection arms 820 do not interfere with movements of the outer enclosure 112 of the furnace 100.

Referring briefly to FIG. 24, the lift fixture 900 is a welded assembly that includes a pair of side beams 910, three transversely extending beams 912 that rigidly connect the side beams 910, and two pairs of cross braces 914 that assist in rigidifying the structure that is defined by the beams 910, 912. Two pairs of end cables 922 and a pair of central cables 924 connect with the side beams 910. The central cables 924 have adjustable turn-buckles 926 interposed therein to provide a means for adjusting cable loadings to ensure that loads are properly distributed among the cables 922, 924 to prevent deformation of the lift fixture 900 and of a base "half" 132 that is carried by the lift fixture 900.

Figure 22:
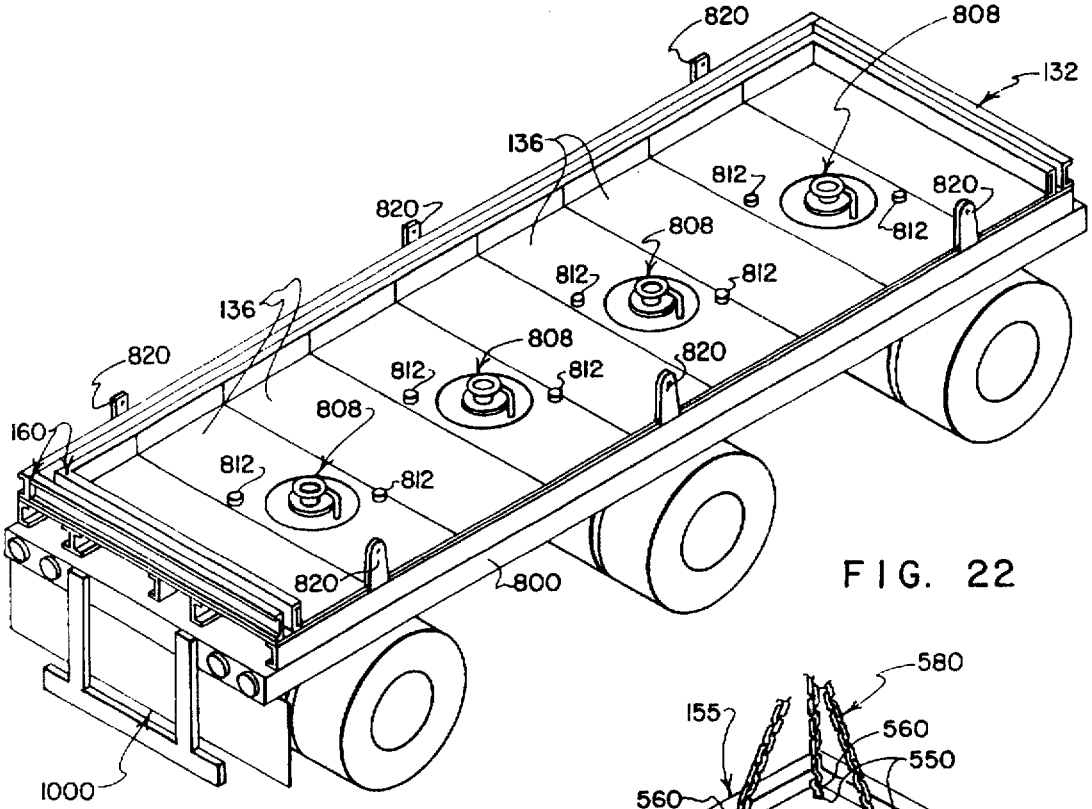
FIG. 22 is a perspective view showing the base support structure "half" of FIGS. 19–21 positioned atop the flat bed of a conventional, plural-axle semi-trailer of the type that is typically coupled to the tractor of a semi-trailer truck for over-the-road transit; and showing an initial blanket of refractory fiber insulation material (comprised of strips of refractory fiber insulation laid side by side), installed atop portions of the base support structure "half" during an early stage of assembly of a base "half;"
Figure 23:
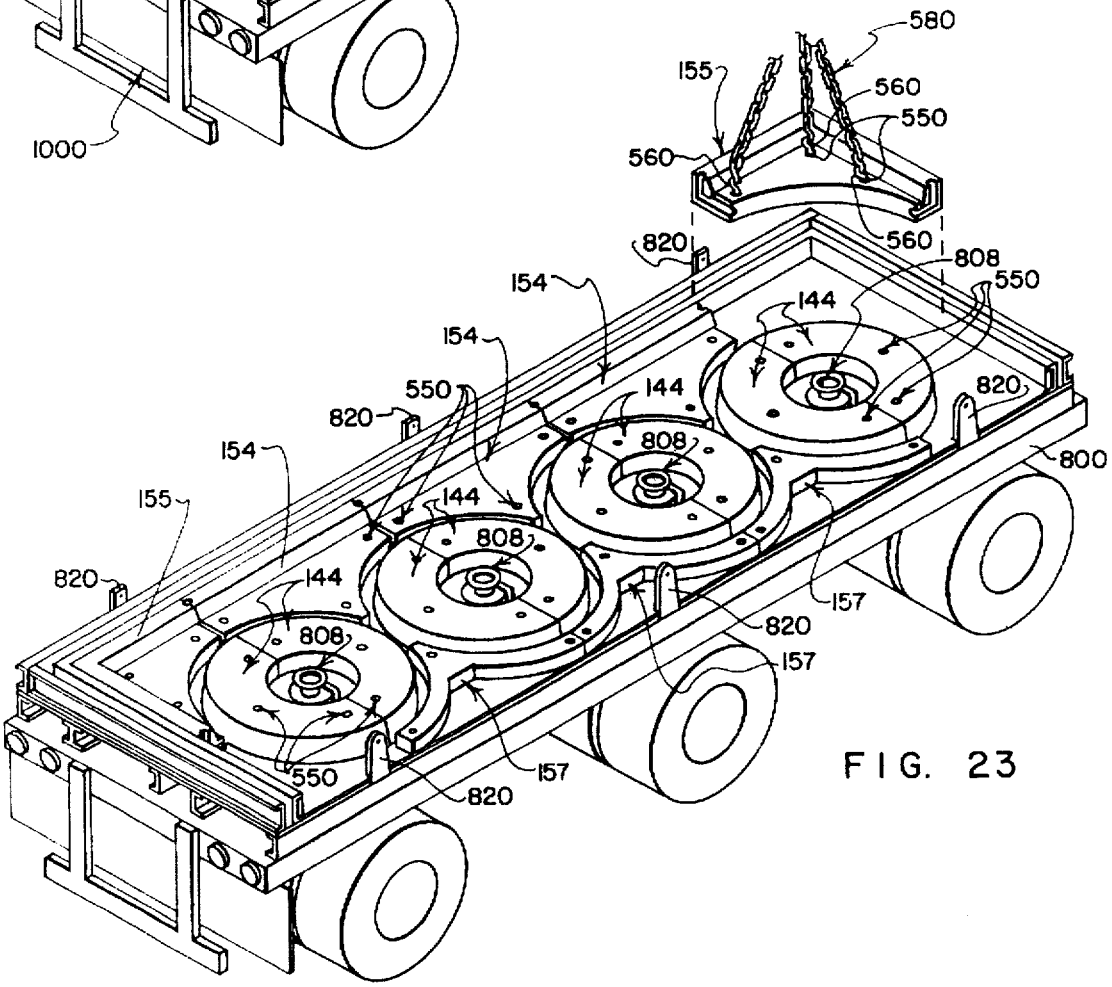
FIG. 23 is a perspective view similar to FIG. 22 depicting the accomplishment of additional steps in the process of assembling a base "half," with one of the cast refractory segments being crane-supported as during its movement toward a position where it will be installed.

Returning to FIGS. 19–21, fabrication of the welded steel base support structure 132 preferably is carried out while the I-beams 800 are carefully supported, with both of the beams 800 being level so that, as the end plates 802, the transverse beams 804 and the like are welded in place, the resulting structure 132 will be flat and true. Once the structure 132 has been fully welded, it can be lifted (utilizing a crane and the lift fixture 900) onto the flat bed of a semi-trailer 1000, depicted in FIGS. 22 and 23, where other components of the base assembly 130 then can be installed.

Figure 9:
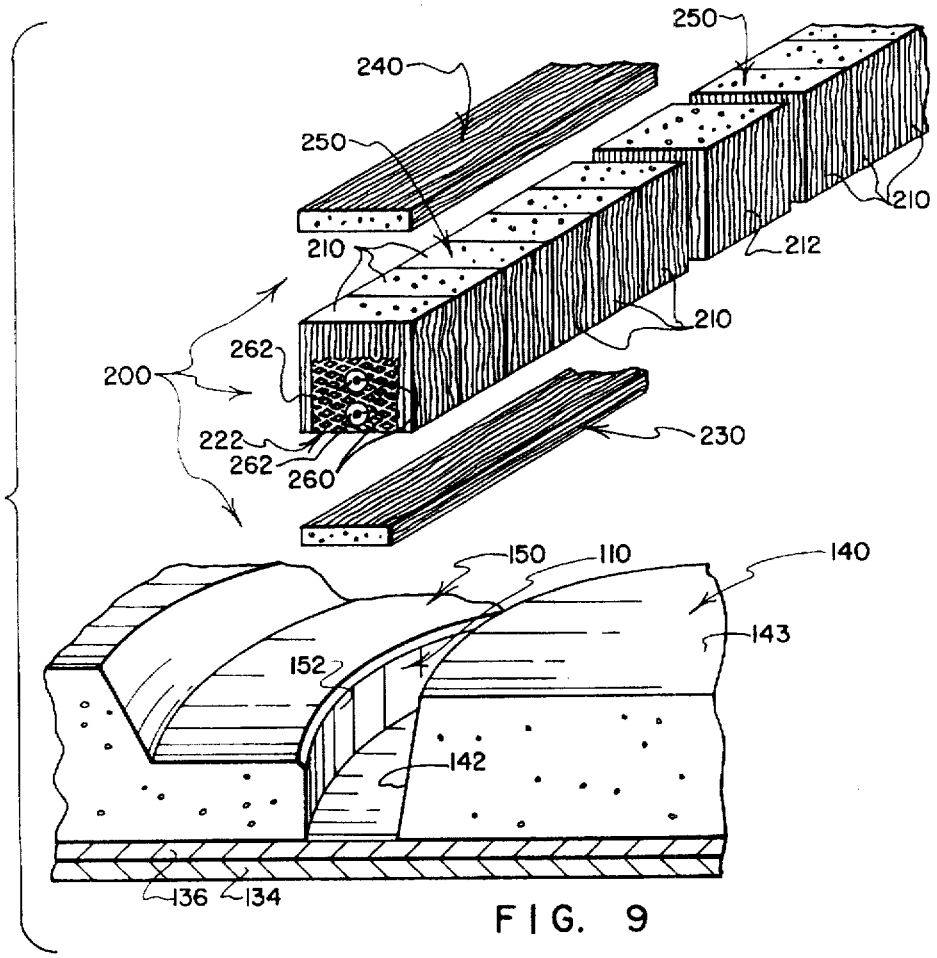
FIG. 9 is an exploded perspective view depicting on an enlarged scale portions of an inner seal positioning trough that is defined between inner and outer segments of the cast refractory base of the furnace of FIG. 1, and depicting selected components that preferably are utilized in forming a fiber seal within the inner seal trough.
Figure 10:
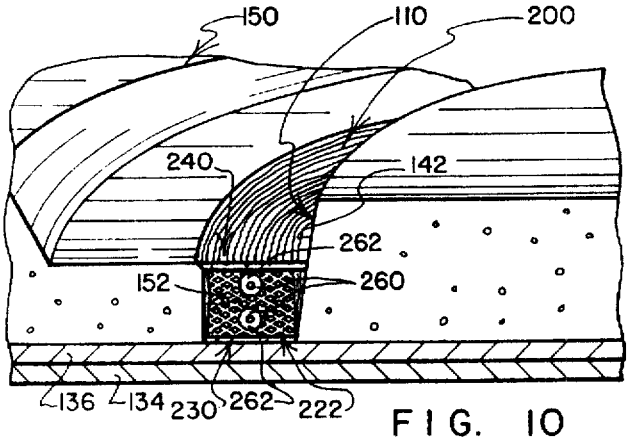
FIG. 10 is a perspective view similar to FIG. 9 but with the fiber seal components of FIG. 8 installed in the inner seal trough to form an inner seal.

Referring to FIGS. 1, 9, 10 and 22, a blanket of refractory fiber material, indicated by the numeral 136, preferably is installed atop the steel plate 134 to underlie the cast refractory inner and outer base structures 140, 150, and to underlie the inner seal troughs 110. While the blanket 136 is depicted in FIGS. 9 and 10 as having a thickness of typically about an inch, it will be understood that the blanket 136 tends to flatten under the heavy weight of the cast refractory inner and outer structures 140, 150, and under the heavy weight of the inner enclosures 102 seated atop the inner seals 200.

Referring to FIG. 1, each of the inner seal troughs 110 (within which one of the inner seals 200 is positioned) constitutes an annular, upwardly opening space that is defined atop the plate 134 and between an associated set of the segments 144 and 154, 155 that form the cast refractory inner and outer base structures 140, 150. A circumferentially extending, radially outwardly facing surface 142 of the inner base structure 140, and an opposed, radially inwardly facing surface 152 of the outer base structure 150 define opposite sides of each of the inner seal positioning troughs 110.

The opposed surfaces 142, 152 are arranged in pairs, with each pair extending substantially concentrically about a separate one of the inner base structures 140. The surfaces 142, 152 of each of the pairs cooperate to define a cross-section of an associated inner seal trough 110 that remains substantially constant along its entire circumferentially extending length—a cross-section preferably is uniform among the troughs 170, and that preferably has a width that narrows with trough depth.

The diminishment of the width of the inner seal positioning trough 110 with trough depth can be achieved by inclining either or both of the surfaces 142, 152 that define opposite sides of the trough 110—preferably to diminish the widths of the inner seal troughs 110 by about one inch per six inches of trough depth.

While a variety of outer seal embodiments can be used in annealing furnace bases that employ the fiber type inner seals, a typical, conventional outer seal 300 formed from sand is what is depicted in FIGS. 1, 2 and 13. In FIG. 2, the furnace base embodiment 130B is depicted as having a part of an inner surface 156B of its outer seal trough 120B defined and lined by hard, wear and impact resistant ceramic inserts 750 (only one being depicted in FIG. 2, but it being understood that other such inserts can be carried where wear resistance of the inner and/or outer structures 140, 150 need to be enhanced). The composition of the inserts 750 will be described in greater detail later herein, as will the manner in which the inserts 750 preferably are anchored to other cast refractory material of the supporting segment, such as cone of the segments 154B.

As those who are familiar with annealing furnace operation will readily understand, it is the function of the inner seal 200 to cooperate with the depending rim 108 of the inner enclosure 110 to maintain a closed environment treatment chamber 170, within which a charge of metal 190 can be supported for being subjected to an annealing process wherein a positive pressure, non-oxidizing atmosphere typically is maintained within the treatment chamber 170 (i.e., within the inner enclosure 110) while a furnace chamber 180 (defined within the outer enclosure 120) is heated by conventional furnace structure (not shown) to bring the treatment chamber 170 to a desired elevated temperature, whereafter controlled cooling of the charge of metal 190 is permitted to take place in the treatment chamber 170 to bring the charge of metal 190 back to near ambient temperature.

As is depicted in FIG. 1, the charge of metal 190 that typically is treated in the furnace 100 includes a plurality of coils 191, 192, 193 of steel, with convector plates 60 being inserted between adjacent pairs of the coils to space the coils apart and to provide for circulation of gas therebetween. A desirable type of convector plate 60 to use for such a purpose is described in Coble U.S. Pat. No. 5,048,802. To support the charge of metal 190 atop the cast refractory components of the base 130 (and the same is true with respect to the base 130A of FIG. 13), an assembly of metal base components, that form what is referred to as a "diffuser base," indicated generally by the numeral 50, is positioned atop the cast refractory inner structure 140. Desirable types of diffuser base components 50, and the preferred manner in which these components are utilized, are described in detail in the above-identified Annealing Furnace Patents of Gary L. Coble.

A fan 70 having a rotary impeller 72 is disposed substantially centrally among the metal base components 50 for circulating non-oxidizing gases within the closed environment of the treatment chamber 170. During an annealing operation, the fan 70 is operated to circulate an inert gas within the treatment chamber 170 among the coils of steel 191, 192, 193 while a furnace heating system (typically carried by the outer enclosure 112, but not shown in the drawings inasmuch as the nature of heating systems used by annealing furnaces are quite well known and forms no part of the present invention) heats the furnace chamber 180 so that the inner enclosure 102 is heated which, in turn, causes the gases within the treatment chamber 170 to be heated. The temperature of the gases that are circulated within the treatment chamber 170 typically is elevated to as high as 1500 degrees Fahrenheit (sometimes higher) for a period of time sufficient to heat and treat the steel that forms the coils 191, 192, 193, and then is slowly lowered to ambient temperature to complete the annealing process, whereafter the enclosures 102, 112 are raised to permit the coils 191, 192, 193 to be removed, and to the process to be repeated with a new charge of metal.

Each of the cast refractory segments 144, 154, 155 is "cast" (i.e., each is individually formed in a separate mold—which molds must be quite large in size inasmuch as the segments 144, 154, 155 that are to be formed also are quite large in size), utilizing a castable refractory material that, when set and cured, will provide segments 144, 154, 155 that will withstand some reasonable amount of being bumped about while being transported to and installed at a furnace site.

While improvements in, and new forms of, castable refractory materials are constantly being made, the preferred type of castable refractory material that presently is utilized to mold-form the segments 144, 154, 155 to provide rigid ceramic structures that will withstand use in a steel production facility where temperatures are repeatedly cycled between ambient temperature and temperatures of about 1500 degrees Fahrenheit (and higher) are low cement containing mixtures that include about 45 to about 47 percent alumina ($Al_2O_3$), about 45 to 47 percent silica ($SiO_2$), and that contain about 2 percent, by weight, of thin stainless steel needles (that typically are about an inch in length and are included to provide strength and reinforcement to the resulting product) which are mixed with a sufficiently small quantity of water to barely bring the material to a dry granular consistency that can be fed into a mold without causing a cloud of dust to arise as the mix is fed into the mold, and which require the presence of power-induced mold vibration in order to ensure that the material is properly distributed throughout the mold to form a mixture of even consistency that can be cured to form a strong, temperature-cycle-resistant product.

While castable refractory materials of the type just described are commercially available from a variety of sources, a presently preferred castable refractory is sold by Premier Refractories and Chemicals, Inc. of King of Prussia, Pa. 19406 under the product designation "Criterion 45," which is described as being an alumina and silicate based, general-duty, low cement containing, vibration castable that needs to be mixed with relatively little water, and that can provide cast products of relatively high density, relatively low porosity, and relatively high strengths—as compared with products produced from other forms of present-day-available cast refractory materials. Cast refractory products formed with this material are understood to perform in environments that are cycled repeated between ambient temperature and elevated temperatures as high as about 2800 degrees Fahrenheit.

Figure 14:
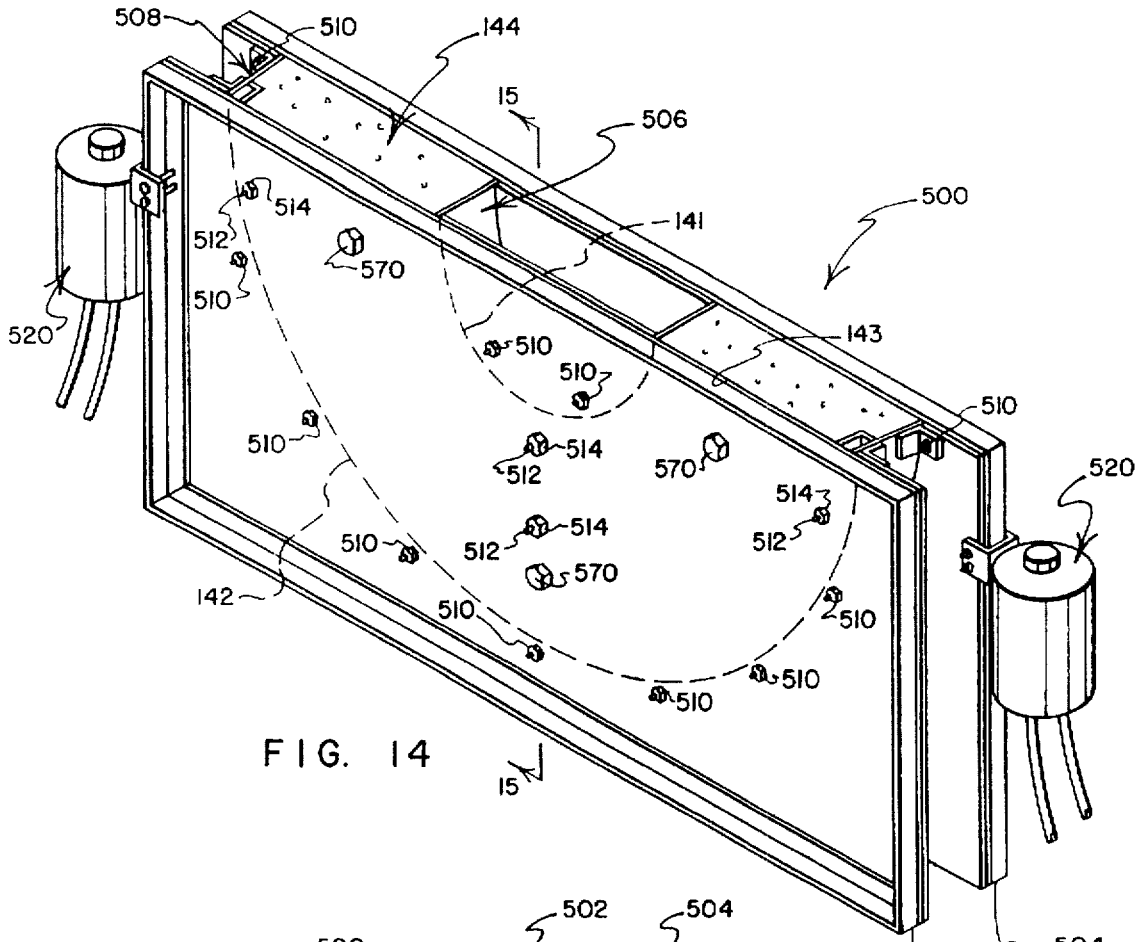
FIG. 14 is a perspective view of a disassemblable mold of the general type that preferably is utilized to mold-form castable refractory material to cast the inner and outer cast refractory segments that are employed in annealing furnace bases that embody the preferred practice of the present invention, with a pair of power operated mold vibrators clamped to the mold for vibrating the mold during the introduction into and distribution within the mold of castable refractory material.
Figure 15:
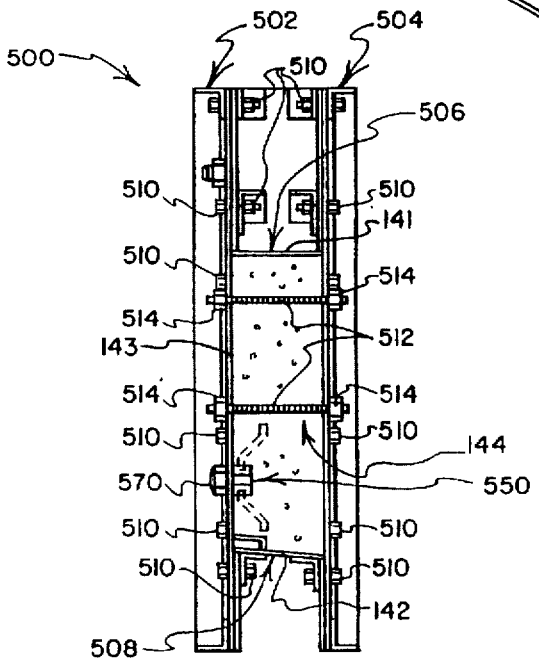
FIG. 15 is a sectional view as seen from a plane indicated by a line 15—15 in FIG. 14.

Referring to FIGS. 14 and 15, a typical form of disassemblable steel mold that preferably is utilized to form one of the C-shaped inner segments 144 is indicated by the numeral 500. The mold 500 has a pair of opposed front and rear side structures 502, 504 that preferably are formed as welded assemblies front structural steel forms such as angle iron, and steel plate stock. Curved inner and outer surfaces 141, 142 of a C-shaped segment 144 are formed by appropriately curved steel plates 506, 508 that are installed between the front and rear structures 502, 504. Bolts 510 extending through appropriately positioned bolt holes are utilized to connect the front and rear structures 502, 504 to the curved plates walls 506, 508—and are removable to permit the mold 500 to be disassembled when a newly molded segment 144 is to be removed therefrom.

Also serving to tie the front and rear structures together are four threaded rods 512 that extend through aligned holes formed in the front and rear structures 502, 504, and through the segment-defining cavity of the mold 500, with opposite ends of the rods 512 being connected to the structures 502, 504 by nuts 514.

Referring to FIG. 14, in order to powerfully vibrate the mold 500 during the feeding into and during distribution within the mold 500 of castable refractory material, a pair of commercially available mold vibrator units 520 (typically pneumatically operated, are shown clamped to opposite corner regions of the mold 500. The vibrator units 520 are widely available, and are commonly employed when "vibration casting" is called for, as will be readily understood by those who are skilled in the art.

The front structure 502 of the mold 500 forms a, "top" surface 143 of a C-shaped inner segment 144 that is being formed in the mold 500—meaning that, when the inner segment 144 is positioned for use in the furnace 100, the surface 143 will face upwardly. To facilitate the connecting of a crane to the segment 144 for use in moving the segment from place to place (and in final positioning the segment 144 at a furnace site), three identical lift connectors 550 are embedded within the segment 144 during molding of the segment 144, one of which is depicted in the sectional view of FIG. 15, but is best seen in the sectional view of FIG. 18.

Figure 17:
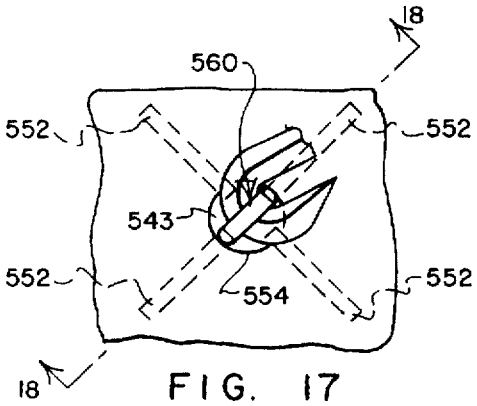
FIG. 17 is a top plan view on an enlarged scale of a portion of the segment of FIG. 16, as seen from a plane indicated by a line 17—17 in FIG. 16, with hidden lines depicting the deployment of anchor portions of a typical one of three lift connections that extend into the cast refractory material of the segment.
Figure 18:
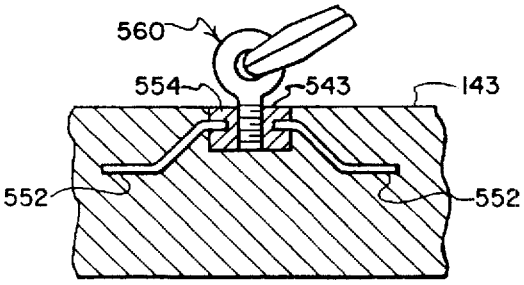
FIG. 18 is a sectional view as seen from a plane indicated by a line 18—18 in FIG. 17.

Referring to FIGS. 17 and 18, the lift connector 550 includes four dog-legged anchor formations 552 that extend into the cast refractory material of the segment 144 from a centrally located hub 554 that has a threaded passage 556 extending therethrough. An outer surface 543 of the hub 554 is positioned to extend flush with the front surface 143 of the segment 144—and the threaded passage 556 opens through the outer surface 543 so that an eyebolt 560 can be removably treaded into the passage 556.

Figure 16:
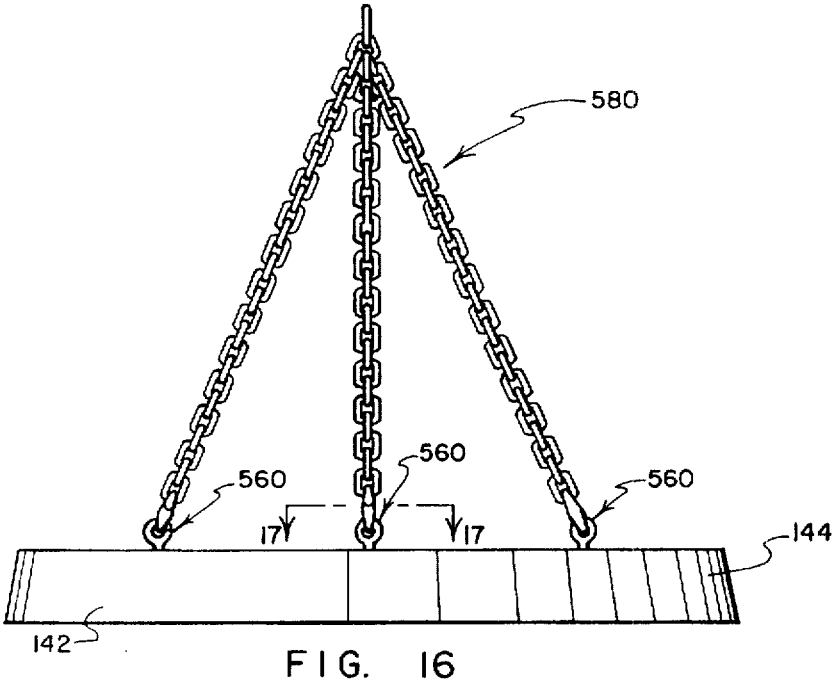
FIG. 16 is a side elevational view depicting a crane-connected, triumvirate type lifting fixture supporting a typical one of the cast refractory segments in a horizontally extending attitude, as during segment positioning and installation.

Three of the lift connectors 550 are incorporated into each of the cast refractory segments 144, 154, 155 at spaced locations—as is indicated in FIG. 3 by the numerals 550. A triumvirate type sling 580, as depicted in FIG. 16, can be connected to three eyebolts 560 that are threaded into the three lift connectors 550 of each of the segments 144, 154, 155 to move the segments 144, 154, 155 one at a time from place to place, and +0 final-position the segments 144, 154, 155 at a furnace site, while holding each of the segments 144, 154, 155 in a horizontal attitude. By this arrangement, there is no need to wrap chains or cables about the segments 144, 154, 155 to lift and move the segments 144, 154, 155; nor is there a need to try to balance the segments 144, 154, 155 on the forks of a lift truck or the like—which can cause unwanted chipping, cracking and other forms of segment damage and deterioration.

Referring to FIGS. 14 and 15, to hold the lift connectors 550 in place within the mold 500 during casting of the segment 144, three bolts 570 are threaded through holes formed in the front structure 502 and into the threaded passages 556 of three of the lift connectors 550. Once the molding of the segment 144 has been completed, the bolts 570 are removed so that the newly cast segment 144 does not remain securely bolted to the front structure 502. And, in the same general manner that has Just been described, others of the segments 144, 154, 155 are moldformed from castable refractory material, and are provided with anchored-in-place lift connectors 550.

The cast refractory outer segments 154B, 155B that are employed in the furnace base embodiment 130B that is depicted in FIG. 2 may have an added complication that needs to be taken into account when they are molded—namely a need to secure the hard, wear and impact resistant, pre-cast ceramic inserts 750 to such other cast refractory material as comprises the segments 154B, 155B, with the inserts 750 positioned at desired locations along outer surfaces of the segments 154B, 155B, with wire-like anchor formations 751 of the inserts 750 projecting into the cast refractory material of the segments 154, 155—in much the same manner that the doglegged anchor formations 552 of the lift connectors 550 extend into the cast refractory material of the inner segments 144. As those who are skilled in the art will readily understand, the inserts 750 are installed in suitably configured molds (not shown) at desired locations before the cast material used the mold the segments 154B, 155B is fed into the molds, whereby, as the cast material of the segments 154B, 155B hardens, the anchors 751 establish a secure bond between the inserts 750 and the other cast refractory material that forms the segments 154B, 155B. The purpose served by the hardened inserts 750 is to increase the service life of the segments 154B, 155B (or such other segments as may be provided with hardened inserts) so that impacts and abrasions of the type that typically can occur when the cover 112 is being positioned can be withstood by the segments 154B, 155B without suffering undue damage.

While hard, wear and impact resist inserts 750 can be formed from a wide variety of commercially available refractory materials, one commercially available refractory material that has been found to be particularly well suited for this purpose is a so-called "slurry infiltrated fiber castable" (known by the acronym "SIFCA") that utilizes a refractory castable slurry to infiltrate a high volume of stainless steel fiber (it can contain up to 16 percent by volume of stainless steel fiber) to form a hard, wear and impact resistant mold-formed article that will function well in environments that cycle through temperature ranges that extend from ambient temperature through temperatures well in excess of 2000 degrees Fahrenheit. The slurry composition that is used is a low cement castable comprised of about 65 percent $Al_2O_3$ a more complete description of which is provided in U.S. Pat. No. 4,366,255 issued Dec. 28, 1982, the disclosure of which is incorporated herein by reference.

Referring to FIGS. 8–10, the inner seal 200 preferably is formed as a serial array of generally cube shaped fiber refractory blocks 210, 212, interspersed among which are a plurality of thin pieces of perforated metal 220, 222 (preferably stainless steel) with the array of fiber blocks 210, 212 and metal members 220, 222 being underlaid by a narrow, elongate blanket 230 of fiber refractory material that is installed in bottom portions of the inner seal trough 110, and being overlaid by a narrow, elongate blanket 240 of fiber refractory material that is installed in upper portions of the inner seal trough 110.

Referring to FIG. 5, the blocks 210, 212 of fiber refractory material preferably are cut from an elongate log or bar 214 of fiber refractory material that is preferably is selected to have a width that will extend the full distance between the inner and outer surfaces 142, 152 at the widest dimension of the trough 110 that is to be occupied by the fiber blocks 210, 212, and a height that preferably is approximately equal to the width.

In preferred practice, the upper portion of the inner seal trough 110 that is to be occupied by the blocks 210, 212 measures six inches in width; the log or bar 214 of fiber refractory material from which the blocks 210, 212 are cut has width and height dimensions of six inches; a plurality of identical blocks 210, 212 measuring six inches by six inches by six inches are cut from the log or bar 214; and the bottom region of the trough 110 into which the blocks 210, 212 are to extend has a width of about five inches—so that, as the blocks 210, 212 are pressed down into the trough 110, bottom regions of the blocks 210, 212 are wedged and compressed a bit to ensure a snug fit in the trough 110.

Because the log or bar 214 of fiber refractory material from which the fiber blocks 210, 212 are cut typically is formed from elongate fibers of refractory material that are blow-formed to fabricate the log 214 in such a way that it tends to have fluffy "layers" of fiber (indicated generally by the numeral 216 in FIGS. 5–9) with a very perceptible direction of fiber orientation (indicated generally by arrows 218, 219 in FIGS. 5 and 6), care needs to be taken in selecting the manner in which the fiber blocks 210, 212 are oriented for insertion into the trough 110. After the blocks 210, 212 are cut from the log or bar 214, each of the blocks 210, 212 preferably is re-oriented by turning it in a right-angle manner that is indicated by an arrow 219 in FIGS. 5 and 6 before the re-oriented blocks 210, 212 are positioned side by side in the manner that is indicated in FIG. 6 to form the array that ultimately is inserted into the inner seal trough 110 to form the heart of the inner seal 200. By this arrangement, when the array of fiber blocks 210, 212 and metal members 220, 222 is installed in the trough 110, the "planes" 216 of fibers of the blocks 210, 212 will extend generally radially relative to the inner structure 140, not circumferentially with respect to the trough 110.

Referring to FIGS. 6 and 7, in preferred practice, approximately six adjacent ones of tie reoriented fiber blocks 210 are selected to form a fiber seal module 250 that can be put in place in the trough 110 as a unit. An assembled module 250 is depicted in FIG. 7. Portions of components included in the module 250 are depicted in FIG. 6. As will be apparent from comparing the fiber blocks 210 as they are depicted in FIGS. 6 and 7, when the module 250 is assembled, the fiber blocks 210 preferably are compressed to tightly sandwich such thin expanded metal members 220 as are interspersed among the fiber blocks 210 of the module.

In this document, the word "interspersed" is utilized in a normal way to designate placement of the metal members 220, 222 "at intervals in an and/or among" the Fiber blocks 210—which includes the preferred way of arranging the metal members 220, 222, namely between adjacent ones of the blocks 210, and also allows for the possibility that metal members 220 also could be inserted among the layers of fibers 216 within the blocks 210, 212. In preferred practice, seven thin metal members 220, 222 are utilized together with six fiber blocks 210 to form a module 250, with five of the metal members 220 each being sandwiched between separate adjacent pairs of the six fiber blocks 210, and with the remaining two metal members 222 serving end caps for the module 250.

To hold the module 250 together, two thin stainless steel rods 260 preferably are inserted through the six fiber blocks 210 and through the seven metal members 220, 222; washers 262 are installed on opposite ends of the rods 260; and ends of the rods 260 are welded to the washers 262 at locations that will hold the fiber blocks 210 and metal members 220, 222 of the module 250 in a suitably compressed form. Suitable module compression preferably is achieved by causing the end cap metal members 222 to be pressed toward each other to the extent that is needed to uniformly compress each of the fiber blocks 210 of the module to about two thirds of its normal length. In preferred practice, If each of the fiber blocks 210 measures six by six by six inches in size, compression of the blocks 210 during formation of a module 250 serves to reduce each of the blocks 210 to about six by six by four inches, with the resulting six-block module 250 having an overall length of about twenty four inches.

In preferred practice, a plurality of modules 250 of the type just described are utilized in forming the inner seal 200. Between each assembled module 250, a single fiber block 212 preferably is installed as a "spacer;" and, each of these "spacer" blocks 212 preferably is compressed to about two thirds of its normal length during the installation of the modules 250 and spacer blocks 212. If, when the installation of an inner seal 200 is about to be completed, it is found that room does not remain within the inner seal trough 110 to insert yet another full module 250 (but too much room remains in the trough 110 to be filled by only one of the compressed spacer blocks 212), more than one of the spacer blocks 212 can be installed in compressed form between selected adjacent pairs of the modules 250—so that not more than two or three of the compressed spacer blocks 212 will need to be installed between any of the adjacent pairs of modules 250.

Because the modules 250 tend to be straight (linear in nature) when formed, but need to be installed in an inner seal trough 110 that is curved, each of the modules 250 can be slightly bent, as is depicted in FIG. 8, prior to being installed. The thin diameter of the stainless steel rods 260 that extend through each of the modules 250 permits this, and the positioning of the two rods 260 of each module 250 one atop the other ensures that the presence of the rods 260 does not severely hinder efforts to deflect the shape of the modules 250 to conform to the curvature of the inner seal trough 110.

Figure 11:
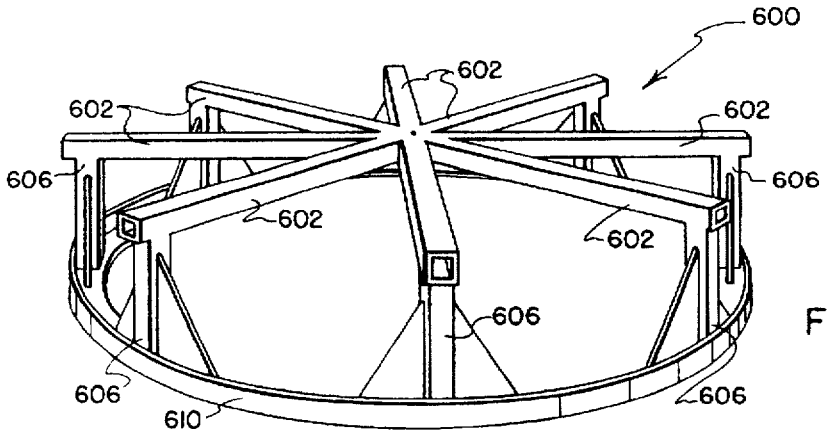
FIG. 11 is a perspective view of a special tool that, in accordance with preferred practice, is utilized in the assembly, maintenance, repair and rebuilding of trough-installed fiber seals that embody features of the present invention.

While the modules 250 and spacer blocks 212 normally can be installed one at a time in the inner seal trough 110, by hand, with good success, pressing the modules 250, spacer blocks 212 and blankets 230, 240 into position to final-form an inner seal 200 preferably is carried out with the aid of a special tool 600 that is depicted in FIG. 11. Referring to FIG. 11, the tool 600 is a "compression fixture" that has a set of spoke-like bars 602 that connect at the center 604 of the tool 600, and that support depending uprights 606 that connect with a compression ring 610. The compression ring 610 has a flat bottom surface that is slightly more narrow than the width of the inner seal trough 110. The compression ring 610 is sized to be positionable atop a newly installed inner seal 200, as is illustrated in FIGS. 112 and 13, and is sufficiently strong to permit a heavy object, such as a coil of steel 191, to be seated atop the spoke-like bars 602 so that the weight of the coil 191 can be transferred to the compression ring 610 for pressing downwardly against the inner seal 200 to flatten and shape the top surface of the inner seal 200, and to ensure that all components of the inner seal 200 are seated and positioned within the inner seal trough 110.

The compression tool or fixture 600 also preferably is utilized periodically between operational cycles of the furnace 100 to again press and shape the inner seal 200—which tends to have something of a rejuvenation effect to restore life to and maintain the life of the inner seal 200. Likewise, if one or more components of the inner seal 200 (for example the upper, blanket 240) has been repositioned or replaced, the compression fixture 600 preferably is utilized to press and reform the seal 200 before the seal 200 is again put into service.

The refractory fiber insulation that is used to form the underlying blankets 136, 230, the overlying blanket 240, and the fiber blocks 210, 212 should comprise a man-made refractory ceramic fiber product that is characterized by substantially uniform consistency, by a melting point of no less than about 3200 degrees Fahrenheit, and that is capable of rendering lengthy service without encountering significant deterioration while being cycled through a range of temperatures ranging from ambient temperature to about 1500 degrees Fahrenheit (and while being maintained at relatively high temperatures such as 1500 degrees Fahrenheit). Such products are available commercially from a variety of sources, for example from Thermal Ceramics, Inc. of Augusta, Ga. 30903 sold under trademarks KAO-WOOL and PYRO-LOG R, or from Carborundum Company, Fibers Division, Niagara Falls, N.Y. 14302 under the trademark DURA-BLANKET S. Such materials are available in blanket form and in log form, as needed to form the blanket-like members 136, 230 and 240 and the fiber blocks 210, 212, respectively.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. While orientation terms as "upwardly," "downwardly," "leftwardly," "rightwardly" and the like have been utilized in describing the invention, these terms should not be interpreted as being limiting. It is intended that the patent shall cover, by suitable expression in the appended claims, whatever features of patentable novelty exist in the invention disclosed.

What is claimed is:

1. A set of components that are assemblable atop a base support structure of a plural-stack annealing furnace to provide a rigid ceramic refractory base for extending in substantially concentric, annular relationship about each of a plurality of spaced-apart blower mounts of the furnace, for underlying and extending perimetrically about each of a plurality of spaced-apart charge support structures of the furnace that are of generally circular shape and that are configured to overlie the blower mounts to centrally support a plurality of charges of metal that are to be annealed, and for defining concentrically extending, relatively resilient annular inner seals that extend perimetrically about the charge support structures, atop which inner enclosures of the furnace can be removably seated for defining a plurality of controlled environment treatment chambers within which charges of metal that are positioned atop the charge support structures can be confined for treatment during an annealing process, comprising:

a) inner cast ceramic refractory segments means for defining annular inner portions of the rigid ceramic refractory base, including a plurality of separate sets of cast refactory inner segments, with each of said sets being configured 1) to define a separate associated annular-shaped inner portion of the rigid ceramic refractory base for extending substantially concentrically about a separate associated one of a plurality of blower mounts of a plural-stack annealing furnace, 2) to underlie and support a separate associated one of a plurality of generally circular charge support structures of the furnaces and 3) to define a separate associated one of a plurality of substantially continuous, radially outwardly facing surfaces that each extends substantially concentrically about a separate associated one of the circular charge support structures at a location near the periphery thereof;

b) outer cast ceramic refractory segment means for defining outer portions of the rigid ceramic refractory base, including a plurality of cast refractory outer segments that, taken together, comprise a set of outer segments that can be arranged side by side to cooperatively define an outer region of the rigid ceramic refractory base near which an outer enclosure of the furnace can be removably positioned, and that, taken in smaller groups, comprise a plurality of outer segment sub-sets, with the segments of each sub-set being co-operable to extend about an associated separate one of said annular-shaped inner portions to define arcuate portions of a separate associated, radially inwardly facing surface that extends concentrically about a separate associated one of said radially outwardly facing surfaces so as to cooperate therewith to define opposite, radially spaced sides of an associated inner seal positioning trough for extending circumferentially about a separate associated one of the circular charge support structures of the furnace; and, c) inner seal means for being positioned in said troughs atop the base support structure of the furnace for defining a plurality of inner seals that each extend in a substantially uninterrupted manner about the periphery of a separate associated one of the circular charge support structures, that each is capable of supporting at least a part of the weight of a separate associated open-bottom inner enclosure of the furnace when bottom rim portions of the associated inner enclosure are seated thereatop, and that each is sufficiently resilient to cooperate with the seated bottom rim portions of the associated inner enclosure to form a gas impervious seal for isolating the environment of an associated treatment chamber.

2. The set of components for a plural-stack annealing furnace of claim 1 defining in assembled relation a base for an annealing furnaces.

3. The set of components of claim 1 wherein each set of cast refractory inner segments includes a plurality of generally arcuate-shaped cast refractory inner segments that are configured to be positioned side by side to cooperatively define the associated annular inner portion of the rigid ceramic refractory base, and to cooperatively define the associated radially outwardly facing surface.

4. The set of components for a plural-stack annealing furnace of claim 3 defining in assembled relation a base for an annealing furnace.

5. The set of components of claim 3 wherein all of the generally arcuate-shaped cast refractory inner segments are of substantially identical configuration and are therefore interchangeable one with another.

6. The set of components for a plural-stack annealing furnace of claim 5 defining in assembled relation a base for an annealing furnace.

7. The set of components of claim 1 wherein at least one of the sets of cast refractory inner segments includes a pair of substantially identically configured, half-circle shaped inner segments.

8. The set of components for a plural-stack annealing furnace of claim 7 defining in assembled relation a base for an annealing furnace.

9. The set of components of claim 1 wherein at least one of the sets of cast refractory inner segments includes a plurality of inner segments that are positionable side by side to define the associated radially outwardly facing surface as having a truncated conical form that is inclined with respect to the associated radially inwardly facing surface so as to narrow the width of bottom portions of the associated inner seal positioning trough so that, as the associated inner seal is compressed within the associated trough by the seating of the associated inner enclosure of the furnace atop the associated inner seal, the associated inner seal will be wedged by narrowing bottom portions of the associated trough and will therefore continue to extend substantially the full radially measured distance between the associated radially outwardly facing surface and the associated radially outwardly facing surface.

10. The set of components for a plural-stack annealing furnace of claim 9 defining in assembled relation a base for an annealing furnace.

11. The set of components of claim 1 wherein the inner segment means and the outer segment means are configured such that at least a selected one of each associated pair of said radially outwardly facing surface and said radially outwardly facing surface is of a truncated conical form that serves to narrow the width of bottom portions of the associated inner seal positioning trough so that, as the associated inner seal means is compressed within the associated trough by the seating of the associated inner enclosure of the furnace atop the associated inner seal, the associated inner seal will be wedged by narrowing bottom portions of the associated trough and will therefore continue to extend substantially the full radially measured distance between the associated pair of said radially outwardly facing surface and said radially outwardly facing surface.

12. The set of components for a plural-stack annealing furnace of claim 11 defining in assembled relation a base for an annealing furnace.

13. The set of components of claim 1 wherein the inner segment means and the outer segment means are configured such that each of the inner seal positioning troughs maintains a substantially uniform cross-sectional configuration as it extends circumferentially about the associated charge support structure of the furnace, with said uniform cross-sectional configuration being tapered to narrow toward the bottom region thereof.

14. The set of components for a plural-stack annealing furnace of claim 13 defining in assembled relation a base for an annealing furnace.

15. The set of components of claim 1 wherein each of said outer segment sub-sets includes four individual outer segments, with at least two of the individual outer segments being shared with another sub-set in the sense that said two individual outer segments each define portions of two of said radially inwardly facing surfaces.

16. The set of components for a plural-stack annealing furnace of claim 15 defining in assembled relation a base for an annealing furnace.

17. The set of components of claim 15 wherein each of the four individual outer segments of each of the segment sub-sets defines at least the majority of a quarter circle portion of the associated radially inwardly facing surface, and each of said two individual outer segments also defines at least the majority of a quarter circle portion of another of the radially inwardly facing surfaces.

18. The set of components for a plural-stack annealing furnace of claim 17 defining in assembled relation a base for an annealing furnace.

19. The set of components of claim 15 wherein at least two of said four individual outer segments each has an elongate outer region of the rigid ceramic refractory base atop which the outer enclosure of the furnace can be removably seated.

20. The set of components for a plural-stack annealing furnace of claim 19 defining in assembled relation a base for an annealing furnace.

21. The set of components of claim 19 wherein at least a selected outer surface area of at least one of said side parts which may be engaged by the outer enclosure of the furnace during seating and unseating movement of the outer enclosure is reinforced by forming said selected outer surface area from a cast refractory material that contains a sufficient volume of elongate, stainless steel, needle shaped members to provide said selected outer surface area with enhanced strength and wear resistance.

22. The set of components for a plural-stack annealing furnace of claim 21 defining in assembled relation a base for an annealing furnace.

23. The set of components of claim 21 wherein the cast refractory material that is utilized to reinforce said selected outer surface area is formed as a pre-cast member that has steel anchor formation means extending therefrom for anchoring the pre-cast member to the cast refractory material from which adjacent other portions of said at least one side part is formed.

24. The set of components for a plural-stack annealing furnace of claim 23 defining in assembled relation a base for an annealing furnace.

25. The set of components of claim 19 wherein the outer region of the rigid ceramic base is generally rectangular, and wherein at least one of the individual outer segments has a right-angle shaped outer portion that defines a corner part of said generally rectangular outer region.

26. The set of components for a plural-stack annealing furnace of claim 25 defining in assembled relation a base for an annealing furnace.

27. The set of components of claim 25 wherein at least a selected outer surface area of said right-angle shaped outer portion which may be engaged by the outer enclosure of the furnace during seating and unseating movement of the outer enclosure is reinforced by forming said selected outer surface area from a cast refractory material that contains a sufficient volume of elongates stainless steel, needle shaped members to provide said selected outer surface area with enhanced strength and wear resistance.

28. The set of components for a plural-stack annealing furnace of claim 27 defining in assembled relation a base for an annealing furnace.

29. The set of components of claim 27 wherein the cast refractory material that is utilized to reinforce said selected outer surface area is formed as a pre-cast member that has steel anchor formation means extending therefrom for anchoring the pre-cast member to the cast refractory material from which adjacent other portions of said at least one side part is formed.

30. The set of components for a plural-stack annealing furnace of claim 29 defining in assembled relation a base for an annealing furnace.

31. The set of components of claim 1 wherein the radially inwardly facing surface that is defined by at least one of the sub-sets of outer segments is or generally truncated conical form that is inclined with respect to the associated radially inwardly facing surface so as to narrow the width of bottom portions of the associated inner seal positioning trough so that, as the associated inner seal is compressed within said trough by the seating thereatop of an associated inner enclosure of the furnace, the associated inner seal will be wedged by narrowing bottom portions of the associated trough and will therefore continue to extend substantially the full radially measured distance between the associated pair of said radially outwardly facing surface and said radially outwardly facing surface.

32. The set of components for a plural-stack annealing furnace of claim 31 defining in assembled relation a base for an annealing furnace.

33. The set of components of claim 1 wherein said outer region of the outer segment means includes formation means configured to define at least an inner portion of an outer seal positioning trough that carries an outer seal of the furnace that is engaged by the outer enclosure of the furnace when the outer enclosure is seated atop said outer region.

34. The set of components for a plural-stack annealing furnace of claim 33 defining in assembled relation a base for an annealing furnace.

35. The set of components of claim 33 wherein at least a portion of said formation means is reinforced by forming said portion from a cast refractory material that contains a sufficient volume of elongate, stainless steel, needle shaped members to provide said portion with enhanced strength and wear resistance.

36. The set of components for a plural-stack annealing furnace of claim 35 defining in assembled relation a base for an annealing furnace.

37. The set of components of claim 1 wherein the set of outer segments, when arranged side by side to cooperatively define said outer region as being of generally rectangular shape, define a substantially continuous, perimetrically extending, outwardly facing surface adjacent which an outer seal of the furnace can extend for being engaged by the outer enclosure of the furnace when the outer enclosure is seated atop said outer region.

38. The set of components for a plural-stack annealing furnace of claim 37 defining in assembled relation a base for an annealing furnace.

39. The set of components of claim 37 wherein at least a portion of said perimetrically extending, outwardly facing surface is reinforced by forming said portion from a cast refractory material that contains a sufficient volume of elongate, stainless steel, needle shaped members to provide said portion with enhanced strength and wear resistance.

40. The set of components for a plural-stack annealing furnace of claim 39 defining in assembled relation a base for an annealing furnace.

41. The set of components of claim 1 wherein each of the inner seals includes a separate set of ceramic fiber blocks for being arranged serially in a circumferentially extending, endless array within the confines of an associated one of said troughs, with each of said arrays also including a plurality of relatively thin, perforated metal members for being interspersed among the ceramic fiber blocks of the array to extend substantially radially at circumferentially spaced intervals within the confines of the associated trough, with said blocks having radially extending widths that are sufficient to extend substantially the full radially-measured distance between said radially outwardly facing surface and said radially outwardly facing surface of the associated trough at such locations therein as are to be occupied by said blocks, and with the blocks that are included in each array being sufficient in number and in size to require that said blocks be compressed in directions extending circumferentially with respect to the associated trough in order for all of said blocks to be inserted serially into the associated trough to form said array.

42. The set of components for a plural-stack annealing furnace of claim 41 defining in assembled relation a base for an annealing furnace.

43. The set of components of claim 41 wherein said inner seal means also includes a separate relatively thin lower blanket of ceramic fiber refractory material installed in each of the inner seal positioning troughs to underlie the associated array.

44. The set of components for a plural-stack annealing furnace of claim 43 defining in assembled relation a base for an annealing furnace.

45. The set of components of claim 41 wherein said inner seal means also includes a separate relatively thin upper blanket of ceramic fiber refractory material that is installed in each of the inner seal positioning troughs to overlie the associated array.

46. The set of components for a plural-stack annealing furnace of claim 45 defining in assembled relation a base for an annealing furnace.

47. The set of components of claim 41 wherein a selected set of adjacent ones of the ceramic fiber blocks of one of the inner seals, and such ones of the thin, perforated metal members as are interspersed among the selected set of fiber blocks, are coupled together by connecting means for forming an elongate module that can be lifted and installed as a unit into the associated inner seal positioning trough.

48. The set of components for a plural-stack annealing furnace of claim 47 defining in assembled relation a base for an annealing furnace.

49. The set of components of claim 47 wherein the selected set of fiber blocks that is included in the elongate module includes two fiber blocks that are end blocks located at opposite ends of the elongate module, and at least one central fiber block that is located between the two end blocks, and the connecting means includes at least one thin, elongate member that extends substantially centrally through the elongate module so as to extend through not only the end and central blocks but also through the perforated metal members that are included in the module.

50. The set of components for a plural-stack annealing furnace of claim 49 defining in assembled relation a base for an annealing furnace.

51. The set of components of claim 49 wherein the at least one central fiber block includes at least four central fiber blocks arranged serially between the two end blocks, and the elongate member that extends substantially centrally through the module extends serially through all of the end and central blocks.

52. The set of components for a plural-stack annealing furnace of claim 51 defining in assembled relation a base for an annealing furnace.

53. The set of components of claim 49 wherein the perforated metal members that are included in the module include two metal members that are end blocks located at extreme opposite ends of the elongate module, and at least two central metal members that each are interposed between a separate adjacent pair of the set of fiber blocks that is included in the module, and the elongate member that extends substantially centrally through the module has its opposite ends connected to said end members.

54. The set of components for a plural-stack annealing furnace of claim 53 defining in assembled relation a base for an annealing furnace.

55. The set of components of claim 53 wherein the connecting means includes at least two thin, elongate metal members that extend in spaced, side by side relationship substantially centrally through the elongate module so as to extend through not only the end and central blocks but also through the perforated metal members that are included in the module, with opposite ends of each of the two metal members being connected to said end members.

56. The set of components for a plural-stack annealing furnace of claim 55 defining in assembled relation a base for an annealing furnace.

57. The set of components of claim 55 wherein the set of fiber blocks that is included in than module are substantially uniformly compressed when the module is formed so that the length of the module as measured by the distance between the end members is less than it would be if the module were formed utilizing non-compressed fiber blocks.

58. The set of components for a plural-stack annealing furnace of claim 57 defining in assembled relation a base for an annealing furnace.

59. The set of components of claim 57 wherein the substantially uniform compression of the set of fiber blocks causes each of the blocks of the set to have a length, when compressed to form the module, that is about two-thirds of its non-compressed length.

60. The set of components for a plural-stack annealing furnace of claim 59 defining in assembled relation a base for an annealing furnace.

61. The set of components of claim 47 wherein the elongate module is substantially straight when it is formed, but is sufficiently bendable to enable it to be bent to an arcuate shape prior to being installed in said inner seal positioning trough, with the arcuate shape to which the module can be bent corresponding to the curvature of the associated inner seal positioning trough.

62. The set of components for a plural-stack annealing furnace of claim 61 defining in assembled relation a base for an annealing furnace.

63. The set of components of claim 41 wherein the array of ceramic fiber blocks and thin, perforated metal members that is provided for insertion into a selected one of the inner seal positioning troughs includes a plurality of elongate modules that each include a separate set of adjacent ceramic fiber blocks and such perforated metal members as are interspersed thereamong.

64. The set of components for a plural-stack annealing furnace of claim 63 defining in assembled relation a base for an annealing furnace.

65. The set of components of claim 63 wherein the array of ceramic fiber blocks and thin, perforated metal members that is provided for insertion into said selected inner seal positioning trough includes said plurality of elongate modules and a plurality of spacer fiber blocks, with a sufficient number of spacer blocks being included so that at least one compressed spacer block can be installed between each adjacent pair of the modules when the modules and the spacer blocks are installed in said selected inner seal positioning trough.

66. The set of components for a plural-stack annealing furnace of claim 65 defining in assembled relation a base for an annealing furnace.

67. The set of components of claim 41 wherein each of the fiber blocks that is utilized to form a selected one of the inner seals is comprised of elongate fibers of ceramic refractory material, with the fibers of each block being sufficiently aligned so as to define a readily perceptible direction of orientation that extends substantially parallel to said opposed end surfaces of the block, and each of the fiber blocks is installable in the associated inner seal positioning trough with its end surfaces extending substantially transversely with respect to the length of said trough, whereby the direction of orientation of the fibers of the installed fiber blocks extends generally in radially oriented planes, not circumferentially, with respect to the associated inner seal positioning trough.

68. The set of components for a plural-stack annealing furnace of claim 67 defining in assembled relation a base for an annealing furnace.

69. The set of components of claim 67 wherein the inner seal means additionally includes elongate ceramic fiber refractory blanket means for being positioned in said inner seal positioning troughs, including a separate lower blanket for positioning in each of said troughs that has a width that is sufficient to substantially fill the radially measured width of the associated trough, and that is of sufficient length to extend substantially the full length along the circumference of the associated trough for being installed in the associated trough before the associated array of fiber blocks and metal members are installed therein to underlie the associated array, with the fibers of the blanket being sufficiently aligned so as to define a readily perceptible direction of orientation that extends substantially parallel to the length of the blanket, whereby the direction of orientation of the fibers of the installed lower blanket extends generally circumferentially with respect to the associated trough.

70. The set of components for a plural-stack annealing furnace of claim 69 defining in assembled relation a base for an annealing furnace.

71. The set of components of claim 67 wherein the inner seal means additionally includes elongate ceramic fiber refractory blanket means for being positioned in said inner seal positioning troughs, including a separate upper blanket for positioning in each of said troughs that has a width that is sufficient to substantially fill the radially measured width of the associated trough, and that is of sufficient length to extents substantially the full length along the circumference of the associated trough for being installed in the associated trough after the array of fiber blocks and metal members are installed therein to overlie the associated array, with the fibers of the blanket being sufficiently aligned so as to define a readily perceptible direction of orientation that extends substantially parallel to the length of the blanket, whereby the direction of orientation of the fibers of the installed lower blanket extends generally circumferentially with respect to the associated trough.

72. The set of components for a plural-stack annealing furnace of claim 71 defining in assembled relation a base for an annealing furnace.

73. The set of components of claim 41 wherein the inner seal means additionally includes elongate ceramic fiber refractory blanket means for being positioned in said inner seal positioning troughs, including a separate lower blanket for being positioned in each of said troughs, with each of the lower blankets having a width that is sufficient to substantially fill the radially measured width of the associated trough, and that is of sufficient length to extend substantially the full length along the circumference of the associated trough for being installed in the associated trough before the associated array of fiber blocks and metal members is installed in the associated trough to underlie the associated array.

74. The set of components for a plural-stack annealing furnace of claim 73 defining in assembled relation a base for an annealing furnace.

75. The set of components of claim 41 wherein the inner seal means additionally includes elongate ceramic fiber refractory blanket means for being positioned in said inner seal positioning troughs, including a separate upper blanket for being positioned in each of said troughs, with each of the upper blankets having a width that is sufficient to substantially fill the radially measured width of the associated trough, and that is of sufficient length to extend substantially the full length along the circumference of the associated trough for being installed in the associated trough after the associated array of fiber blocks and metal members are installed in the associated trough to overlie the associated array.

76. The set of components for a plural-stack annealing furnace of claim 75 defining in assembled relation a base for an annealing furnace.

77. The set of components of clam 41 wherein the ceramic fiber blocks that are provided for insertion into a selected one of said inner seal positioning troughs to form an associated inner seal within said selected trough have substantially uniform widths that are at least substantially equal to the maximum width of such portions of said selected trough as are to be occupied by said blocks, and said selected trough is of tapered cross section with a progressively diminishing width being encountered at progressively deeper trough depths, whereby, bottom portions of said blocks are caused to be increasingly width-wise compressed as said blocks are pressed more deeply into said selected trough by the weight of the associated inner enclosure of then furnace being seated atop the inner seal that is formed by said blocks.

78. The set of components for a plural-stack annealing furnace of claim 77 defining in assembled relation a base for an annealing furnace.

79. The set of components of claim 77 wherein the perforated metal members that are provided for insertion into said selected trough have a height that is less than the height of the ceramic fiber blocks that are provided for insertion into said selected positioning trough so that, when bottom portions of said perforated metal members and bottom portions of said ceramic fiber blocks are installed in said selected trough in engagement with a bottom wall of said selected trough, said metal members do not extend as high in said selected trough as do said blocks, whereby said metal members do not reinforce such portions of said fiber blocks as extend into upper portions of said selected trough at locations extending above the height of said metal members.

80. The set of components for a plural-stack annealing furnace of claim 79 defining in assembled relation a base for an annealing furnace.

81. The set of components of claim 79 wherein said members are sufficiently stiff, when inserted into said selected trough to form the associated inner seal, to sufficiently reinforce lower portions of the associated inner seal to prevent the associated inner seal from being crushed within said selected trough to a height that is less than the height of said metal members.

82. The set of components for a plural-stack annealing furnace of claim 81 defining in assembled relation a base for an annealing furnace.

83. The set of components of claim 41 wherein said fiber blocks have a non-compressed shape that is substantially cubical, measuring approximately 6 inches by 6 inches by 6 inches; said metal members are formed from thin pieces of perforated metal that are of about 4 inches by 4 inches in size; the portions of said inner seal positioning troughs that are to be filled by said arrays have depths of about 6 inches, widths at their tops of about 6 inches, and widths at their bottoms of about 5 inches, said fiber blocks are installed so as to extend into the bottom areas of said troughs with bottom portions thereof being compressed during installation to accommodate the bottom area width of said troughs, and said metal members also are installed so as to extend into the bottom area of said troughs.

84. The set of components for a plural-stack annealing furnace of claim 83 defining in assembled relation a base for an annealing furnace.

85. The set of components of claim 83 wherein the inner seals that are established in each of said troughs each additionally includes a lower blanket of ceramic fiber refractory material having a height of about 1 inch and a width that is sufficient to fill the width of the bottom area of the associated trough, for being installed in the bottom area of the associated trough to underlie the associated array of fiber blocks and metal members.

86. The set of components for a plural-stack annealing furnace of claim 85 defining in assembled relation a base for an annealing furnace.

87. The set of components of claim 85 wherein the inner seals that are established in each of said troughs each additionally includes an upper blanket of ceramic fiber refractory material having a height of about 1 inch and a width that is sufficient to fill an upper area width of the associated trough, for being installed in an upper area of the associated trough atop to overlie the associated array of fiber blocks and metal members.

88. The set of components for a plural-stack annealing furnace of claim 87 defining in assembled relation a base for an annealing furnace.

89. The set of components of claim 1 wherein at least a selected one of said inner segment means and said outer segment means includes at least one cast refractory segment that has lift connection means anchored into the cast refractory material from which said one segment is formed for defining three spaced lift attachment points to which connection can be made with a crane to permit said one segment to be lifted and moved about, with each of the three spaced lift attachment points opening through a single outer surface of said one segment that faces upwardly when said one segment is installed as a component of said refractory base.

90. The set of components for a plural-stack annealing furnace of claim 89 defining in assembled relation a base for an annealing furnace.

91. The set of components of claim 1 wherein the outer segment means includes central segment means configured to extend within a space located among at least three sets of inner segments that have been positioned to each extend about a separate one of at least three nonaligned, relatively closely grouped furnace blower mounts for defining at least a central part of the rigid ceramic refractory base located within said space.

92. The set of components for a plural-stack annealing furnace of claim 91 defining in assembled relation a base for an annealing furnace.

93. The set of components of claim 1 wherein the outer segment means includes central segment means configured to extend within a space located among at least four sets of inner segments that have been positioned to each extend about a separate one of at least four relatively closely grouped furnace blower mounts that are arranged in spaced, side-by-side extending rows, for defining at least a central part of the rigid ceramic refractory base located within said space.

94. The set of components for a plural-stack annealing furnace of claim 93 defining in assembled relation a base for an annealing furnace.

95. The set of components of claim 1 for a four-stack annealing furnace wherein the outer segment means includes corner-forming segment means including four right-angle corner segments for defining four right-angle corners of a substantially square cast refractory base, and side-forming segment means including four side segments for defining four side portions of the substantially square cast refractory base that each bridge between a separate pair of the corner segments.

96. The set of components for a plural-stack annealing furnace of claim 95 defining in assembled relation a substantially square base for a four-stack annealing furnace.

97. The set of components of claim 1 for an eight-stack annealing furnace wherein the outer segment means includes corner-forming segment means including four right-angle corner segments for defining four right-angle corners of a substantially rectangular cast refractory base, side-forming segment means including at least four side segments for defining four side portions of the substantially rectangular cast refractory base that each bridge between a separate pair of the corner segments, and center segment means including a plurality of center segments for bridging centrally among adjacent sets of the inner segments.

98. The set of components for a plural-stack annealing furnace of claim 97 defining in assembled relation a base for an eight-stack annealing furnace.

99. A set of components that can be positioned atop a base support structure of an annealing furnace for defining a generally annular inner seal that extends concentrically about an imaginary upstanding axis that defines the center of a stack location of the furnace, comprising: a) inner cast ceramic refractory segment means 1) for extending concentrically in an annular arrangement about said axis for underlying and supporting portions of a charge support element of the furnace that extends concentrically about said axis for underlying and supporting a coil of metal that is to be treated in a treatment chamber that is defined to extend about the coil of metal when an inner enclosure of the furnace is lowered into place so lower portions thereof extend substantially concentrically about and enclose the charge support element, and 2) for defining a substantially uninterrupted, radially outwardly facing surface that extends substantially concentrically about said axis so as to be surrounded by said lower portions of the lowered-in-place inner enclosure; b) outer cast ceramic refractory segment means for defining a substantially uninterrupted, radially inwardly facing surface that extends substantially concentrically 1) about said axis, 2) about said radially outwardly facing surface at a distance spaced therefrom, and 3) about said lower portions of the lowered-in-place inner enclosure so as to cooperate with the inner segment means to define an annular, upwardly opening trough of substantially uniform cross-section as viewed in planes that radiate from said axis its length, into which trough said lower portions of the lowered-in-place inner enclosure extend; c) annular seal means formed at least in part from heat resistant ceramic material for being installed in said trough to define a somewhat resilient seal that is engaged by said lower portions of the lowered-in-place inner enclosure and is caused by force applied to the seal due to the seal's being engaged by said lower portions to deform at least slightly to thereby aid in establishing a substantially gas-impervious seal for the treatment chamber; d) wherein the radially outwardly facing surface and the radially inwardly facing surface cooperate to define said substantially uniform trough cross-section as being tapered so as to widen progressively as the trough opens upwardly; and, e) wherein said annular seal means has a substantially uniform cross-sectional configuration of sufficient radially extending width 1) to ensure that the annular seal means is at least slightly compressed as it is pressed between the radially inwardly and radially outwardly facing surfaces as it is installed into the trough, and 2) to ensure that, if the cross-section of the seal tends to diminish slightly during its service life, the force applied to the seal due to the seal's being engaged by the lowered-in-place inner enclosure will tend to press the seal more deeply into the narrow lower part of the trough where the seal still will have a sufficiently wide cross-section to the bridge between the radially inwardly and radially outwardly facing surfaces.

100. The set of components for a plural-stack annealing furnace of claim 99 defining in assembled relation a base for an annealing furnace.

101. A base assembly for a plural-stack annealing furnace, comprising:

a) a welded steel base support structure having a periphery that defines the shape of the base, having a top surface of said shape defined by plate steel with a plurality of spaced blower mount locations in an array spaced centrally inwardly from the periphery of the base;

b) a blanket of refractory fiber material substantially covering said plate steel top surface;

c) inner cast ceramic retractor, segment means for defining annular inner portions of a rigid ceramic refractory base, including a plurality of separate sets of cast refractory inner segments positioned atop said blanket of refractory fiber material, with each of said sets of cast refractory inner segments being configured 1) to define a separate associated annular-shape inner portion of the rigid ceramic refractory base for extending substantially concentrically about a separate associated one of said blower mount locations, 2) to underlie and support a separate associated one of a plurality of generally circular charge support structures of the furnace, and 3) to define a separate-associated (one fit plurality sustantially continuous, radially outwardly facing surfaces that each extends substantially concentrically about a separate associated one of the circular charge support structures at a location near the periphery thereof;

d) outer cast ceramic refractory segment means for defining outer portions of the rigid ceramic refactory base, including a plurality of cast refractory outer segments positioned atop said blanket refractory fiber material and arranged side by side to cooperatively define atop the blanket of refractory fiber an outer region of the rigid ceramic refractory base of said general shape near which an outer furnace enclosure of said general shape can be removably positioned, with subsets of the outer segments each being co-operable to extend about an associated separate one of said annular-shaped inner portions to define arcuate portions of a separate associated, radially inwardly facing surface that extend concentrically about a separate associated one of said radially outwardly facing surfaces so as to cooperate therewith to define opposite, radially spaced sides of an associated inner seal positioning trough for extending circumferentially about a separate associated one of the circular charge support structures of the furnace; and, c) inner seal means for being positioned in said troughs atop the base support structure of the furnace for defining a plurality of inner seals 1) that each extend in a separate one of said troughs in a substantially uninterrupted manner about the periphery of a separate associated one of the circular charge support structures 2) that each has sufficient structural integrity so as to be capable of supporting at least a portion of the weight of a separate associated open-bottom inner enclosure of the furnace when bottom rim portions of the associated inner enclosure are seated thereatop, and 3) that each is sufficiently resilient to cooperate with the bottom rim portions of the associated seated inner enclosure to form a gas impervious seal for isolating the environment of an associated treatment chamber.

102. The base of claim 101 wherein each of the inner seals includes a separate set of ceramic fiber blocks for being arranged serially in a circumferentially extending, endless array within the confines of a separate associated one of said troughs.

103. The base of claim 102 wherein each of said arrays also includes a plurality of relatively thin, perforated metal members for being interspersed among the ceramic fiber blocks of the array to extend substantially radially at circumferentially spaced intervals within the confines of the associated trough, with said blocks having radially extending widths that are sufficient to extend substantially the full radially-measured distance between said radially outwardly facing surface and said radially outwardly facing surface of the associated trough at such locations therein as are to be occupied by said blocks, and with the blocks that are included in each array being sufficient in number and in size to require that said blocks be compressed in directions extending circumferentially with respect to the associated trough in order for all of said blocks to be inserted serially into the associated trough to form said array.

104. The base of claim 101 wherein at least one of the sets of cast refractory inner segments includes a pair of substantially identically configured, half-circle shaped inner segments.

105. The base of claim 101 wherein the inner segment means and the outer segment means are configured such that at least a selected one of each associated pair of said radially outwardly facing surface and said radially outwardly facing surface is of a truncated conical form that serves to narrow the width of bottom portions of the associated inner seal positioning trough so that, as the associated inner seal means is compressed within the associated trough by the seating of the associated inner enclosure of the furnace atop the associated inner seal, the associated inner seal will be wedged by narrowing bottom portions of the associated trough and will therefore continue to extend substantially the full radially measured distance between the associated pair of said radially outwardly facing surface and said radially outwardly facing surface.

106. The base of claim 101 wherein the inner segment means and the outer segment means are configured such that each of the inner seal positioning troughs maintains a substantially uniform cross-sectional configuration as it extends circumferentially about the associated charge support structure of the furnace, with said uniform cross-sectional configuration being tapered to narrow toward the bottom region thereof.

107. The base of claim 101 wherein each of said outer segment sub-sets includes four Individual outer segments, with at least two of the individual outer segments being shared with another sub-set in the sense that said two individual outer segments each define portions of two of said radially inwardly facing surfaces.

108. The base of claim 107 wherein at least one of said at least two individual outer segments has an elongate outer portion that defines a side part of said outer region of the rigid ceramic refractory base near which the outer enclosure of the furnace can be removably positioned.

109. The base of claim 108 wherein at least a portion of said side part which may be engaged by the outer enclosure of the furnace when the outer enclosure is removably positioned near said outer region as reinforced by forming said selected outer surface area from a cast refractory material that contains a sufficient volume of elongate, stainless steel, needle shaped members to provide enhanced strength and wear resistance.

110. The base of claim 109 wherein the cast refractory material that is utilized to reinforce said selected outer surface area is formed as a pre-cast member that has steel anchor formation means extending therefrom for anchoring the pre-cast member to the cast refractory material from which adjacent other portions of said side part is formed.

111. The base of claim 101 wherein the radially inwardly facing surface that is defined by at least one of the sub-sets of outer segments is of generally truncated conical form that is inclined with respect to the associated radially inwardly facing surface so as to narrow the width of bottom portions of the associated inner seal positioning trough so that, as the associated inner seal is compressed within said trough by the seating thereatop of an associated inner enclosure of the furnace, the associated inner seal will be wedged by narrowing bottom portions of the associated trough and will therefore continue to extend substantially the full radially measured distance between the associated pair of said radially outwardly facing surface and said radially outwardly facing surface.

112. The base of claim 101 wherein the set of outer segments, when arranged side by side to cooperatively define said generally rectangular outer regions additionally define a substantially continuous, perimetrically extending, outwardly facing surface adjacent which an outer seal of the furnace can extend for being engaged by the outer enclosure of the furnace when the outer enclosure is stated atop said outer region.

113. The base of claim 112 wherein at least a portion of said perimetrically extending, outwardly facing surface is reinforced by forming said portion from a cast refractory material that contains a sufficient volume of elongate, stainless steel, needle shaped members to provide said portion with enhanced strength and wear resistance.

114. The base of claim 102 wherein a selected set of adjacent ones of the ceramic fiber blocks of one of the inner seals, and such ones of the thin, perforated metal members as are interspersed among the selected set of fiber blocks, are coupled together by connecting means for forming an elongate module that can be lifted and installed as a unit into the associated inner seal positioning trough.

115. The base of claim 114 wherein the connecting means includes at least two thin, elongate metal members that extend in spaced, side by side relationship substantially centrally through the elongate module so as to extend through not only the end and central blocks but also through the perforated metal members that are included in the module, with opposite ends of each of the two metal members being connected to said end members.

116. The base of claim 115 wherein the set of fiber blocks that is included in the module are substantially uniformly compressed when the module is formed so that the length of the module as measured by the distance between the end members is less than it would be if the module were formed utilizing non-compressed fiber blocks.

117. The base of claim 116 wherein the elongate module is substantially straight when it is formed, but is sufficiently bendable to enable it to be bent to an arcuate shape prior to being installed in the associated inner seal positioning trough, with the arcuate shape to which the module can be bent corresponding to the curvature of the associated inner seal positioning trough.

118. The base of claim 117 wherein tree array of ceramic fiber blocks and thin, perforated metal members that is provided for insertion into said selected inner seal positioning trough includes said plurality of said elongate modules and a plurality of spacer fiber blocks, with a sufficient number of spacer blocks being included so that at least one compressed spacer block can be installed between each adjacent pair of the modules when the modules and the spacer blocks are installed in said selected inner seal positioning trough.

119. The base of claim 101 additionally including upstanding lifting arms affixed to opposite sides of the base support structure at spaced intervals therealong for being connected to a crane to permit the base to be lifted and moved from place to place.

120. The base of claim 119 additionally including lifting fixture means configured to be connected to all of said lifting arms, and providing a single connection that can be coupled to a crane so that, when a crane lifts the lifting fixture means, the lifting fixture means will apply force to said base through said lifting arms to lift said base.

121. A cast refractory base of generally rectangular shape for an eight-stack annealing furnace having two spaced, parallel extending rows of four stack locations, wherein the base is formed from plurality of individually formed cast refractory segments assembled side-by-side atop a generally rectangular base support structure, comprising: a) inner segment means comprising a plurality of generally arcuate-shaped inner segments for extending in an annular manner about spaced center axes of the eight stack locations of the furnace; b) outer segment means comprising four corner-defining segments and at least four side-defining segments for bridging between adjacent pairs of the corner segments to define the generally rectangular shape of the perimeter of the cast refractory base; and, c) center segment means including a plurality of center segments for bridging centrally among adjacent inner segment sets; d) wherein the inner, outer and center segments cooperate to define substantially annular, upwardly opening troughs extending concentrically about the center axes for receiving inner seals that are engaged by inner enclosures of the furnace that each extend about a separate one of the center axes when lowered into operating position to define separate treatment chambers extending about each of the center axes.

122. The cast refractory base of claim 121 wherein the inner, outer and center segments are configured such that the upwardly opening troughs have substantially uniform cross-sections that taper so as to widen progressively as the troughs open upwardly, and annular seal means is provided including a plurality of annular seals that each has a cross-section that causes each annular seal to be compressed to a progressively greater degree the deeper each annular seal is pressed into an associated one of the troughs.

123. The cast refractory base of claim 121 wherein the steel base is formed in two sections, each of which define a separate row of four stack locations, each of which is positioned atop a separate flat bed truck and has selected ones of its inner, outer and central segments installed thereon for transfer as a subassembly to a site where a new cast refractory base is to be installed, with the resulting subassemblies being crane-lifted into installed positions so as to extend side-by-side before all remaining ones of the needed inner, outer and central segments are installed.

124. An annealing furnace seal provided in a given length of an elongate, upwardly-opening trough defined between a pair of spaced, opposed surfaces of an annealing furnace base for being engaged by portions of a cover of the furnace to aid in establishing a gas-impervious seal between the furnace base and the cover extending along said given length, comprising: a) a plurality of ceramic fiber blocks arranged serially within the confines of the trough along said given length thereof, with the blocks having transverse widths that are sufficient to bridge the width of the trough at locations within the trough where the blocks are installed, with the blocks being sufficient in number and size to require that the blocks be compressed in directions extending along the length of the trough to be inserter, serially into the trough; and, b) reinforcement means including a plurality of relatively thin, perforated metal members interspersed among the ceramic fiber blocks and extending generally transversely within the confines of the trough for enhancing the crush resistance of the resulting seal.

125. The annealing furnace seal of claim 124 additionally including elongate means extending substantially centrally through such ones of the ceramic fiber blocks and perforated metal members interspersed thereamong as occupy a selected part of said given length, and being connected to perforated metal members located near opposite ends of said selected part of said given length for positioning the connected perforated metal members to compress such ceramic fiber blocks and interspersed metal members as are located therebetween thereby forming a module of interconnected, compressively sandwiched ceramic fiber blocks and interspersed metal members.

126. The annealing furnace seal of claim 125 wherein said elongate means that compressively sandwiches ceramic fiber blocks and interspersed metal members is curved along its length to substantially correspond to a curvature of the length of said trough that is to be occupied by said module so that said module is caused to curve along its length to correspond to the curvature of the trough length wherein the module is positioned.

127. The annealing furnace seal of claim 125 wherein the elongate means includes at least one steel rod.

128. The annealing furnace seal of claim 125 additionally including a relatively thin lower blanket of ceramic fiber refractory material installed in said trough to underlie said module.

129. The annealing furnace seal of claim 125 additionally including a relatively thin upper blanket of ceramic fiber refractory material installed in said trough to overlie said module.

130. The annealing furnace seal of claim 125 including a plurality of said modules of compressively sandwiched ceramic fiber blocks and interspersed metal members.

131. The annealing furnace seal of claim 130 additionally including a relatively thin, elongate, lower blanket of ceramic fiber refractory material installed in said trough to underlie more than one of said modules.

132. The annealing furnace seal of claim 130 additionally including a relatively thin, elongate, upper blanket of ceramic fiber refractory material installed in said trough to overlie more than one of said modules.

133. A crush-resistant ceramic seal module for insertion into a given length of an elongate, upwardly-opening trough defined between a pair of spaced, opposed surfaces of an annealing furnace base for being engaged by portions of a cover of the furnace to aid in establishing a gas-impervious seal between the furnace base and the cover extending along said given length, comprising:

a) a plurality of ceramic fiber blocks arranged serially for defining an array of ceramic fiber blocks configured to be inserted into the confines of the upwardly opening trough along said given length thereof; with the blocks having transverse widths that are sufficient to bridge the width of the trough at locations within the trough where the blocks are installed, with the blocks being sufficient in number and size to require that the blocks be compressed in directions extending along the length of the trough to be inserted serially into the trough;

b) reinforcement means including a plurality of relatively thin, perforated metal members interspersed among the ceramic fiber blocks for extending generally transversely within the confines of the trough for enhancing the crush resistance of the resulting seal; and, c) elongate means extending substantially centrally through the array of ceramic fiber blocks and through such perforated metal members as are interspersed thereamong, and being connected to end structures located at opposite ends of the array for positioning the end structures to compressively sandwich the array of ceramic fiber blocks and interspersed metal members.

134. The ceramic seal module of claim 133 wherein the elongate means is curved along its length to substantially correspond to a curvature of the length of said trough that is to be occupied by said module so that said module is caused to curve along its length to correspond to a curvature of the trough length wherein the module is positioned.

135. The ceramic seal module of claim 133 wherein the elongate means is sufficiently bendable to enable the module to be bent along its length at a time after the module has been assembled to enable the assembled module to conform to a curvature of the trough length wherein the module is to be positioned.

136. A method of providing a crush-resistant annealing furnace seal in a given length of an elongate, upwardly-opening trough defined between a pair of spaced, opposed surfaces of an annealing furnace base for being engaged by portions of a cover of the furnace to aid in establishing a gas-impervious seal between the furnace base and the cover extending along said given length, comprising the step of positioning within the confines of the trough and extending continuously along said given length a compressed serial array of a plurality of ceramic fiber blocks that have widths that are sufficient to bridge the width of the trough at locations within the trough where the blocks are installed, with the array also including a plurality of relatively thin, perforated metal members interspersed among the ceramic fiber blocks and extending generally transversely within the confines of the trough for enhancing the crush resistance of the resulting seal.

137. The method of claim 136 additionally including the step of positioning elongate means to extend substantially centrally through said array of ceramic fiber blocks and perforated metal members along at least a selected part of said given length, and connecting the elongate means to perforated metal members located near opposite ends of said selected part of said given length for holding the connected perforated metal members in positions compressing such ceramic fiber blocks and interspersed metal members as are located therebetween, thereby forming a module of interconnected, compressively sandwiched ceramic fiber blocks and interspersed metal members.

138. The method of claim 137 additionally including the step of configuring the elongate means to assume a curvature along the length thereof that substantially corresponds to a curvature of a trough length occupied by said module so that said module is caused to curve along its length to correspond to the curvature of the trough length wherein the module is positioned.

139. The method of claim 137 additionally including the step of positioning a relatively thin lower blanket of ceramic fiber refractory material in said trough to underlie said module.

140. The method of claim 137 additionally including the step of positioning a relatively thin upper blanket of ceramic fiber refractory material in said trough to overlie said module.

141. A method of assembling from a set of component parts, at a location atop a base support structure of a plural-stack annealing furnace, 1) a rigid ceramic refractory base for extending in substantially concentric, annular relationship about a plurality of spaced blower mounts of the furnace, for underlying and extending perimetrically about a plurality of charge support structures of the furnace that are of generally circular shape and that are configured to overlie the blower mounts to support a plurality of charges of metal that are to be annealed, and 2) a plurality of relatively resilient annular inner seals that extend perimetrically about the charge support structures, atop which inner enclosures of the furnace can be removably seated for defining a plurality of controlled environment treatment chambers within which charges of metal that are positioned atop the charge support structures can be confined for treatment during an annealing process, comprising the steps of:

a) providing inner segment means including a plurality of sets of cast refractory inner segments, and installing each set of the inner segment means 1) to define a separate associated annular-shaped inner portion of the rigid ceramic refractory base for extending substantially concentrically about a separate associated one of a plurality of blower mounts of a plural-stack annealing furnace, 2) to underlie and support a separate associated one of a plurality of generally circular charge support structures of the furnace, and 3) to define a separate associated one of a plurality of substantially continuous, radially outwardly facing surfaces that each extends substantially concentrically about a separate associated one of the circular charge support structures at a location near the periphery thereof;

b) providing outer segment means including a set of cast ceramic refractory outer segments, and installing the outer segment means so that the outer segments extend side by side to cooperatively define an outer region of the rigid ceramic refractory base near which an outer enclosure of the furnace can be removably positioned, with smaller groups of the outer segments of the set comprising outer segment sub-sets, with the segments of each sub-set extending about an associated separate one of said annular-shaped inner portions to define arcuate portions of a separate associated, radially inwardly facing surface that extends concentrically about a separate associated one of said radially outwardly facing surfaces so as to cooperate therewith to define opposite, radially spaced sides of an associated inner seal positioning trough for extending circumferentially about a separate associated one of the circular charge support structures of the furnace; and, c) providing inner seal means including a plurality of separate inner seals, and installing each of the inner seals atop the base support structure of the furnace and in a separate one of said troughs, with the installed inner seals 1) each extending in a substantially uninterrupted manner about the periphery of a separate associated one of the circular charge support structures, 2) each being capable of supporting at least a part of the weight of a separate associated open-bottom inner enclosure of the furnace when bottom rim portions of the associated inner enclosure are seated thereatop, and 3) each being sufficiently resilient to cooperate with the seated to rim portions of the associated inner enclosure to form a gas impervious seal for isolating the environment of an associated treatment chamber.

142. The method of claim 141 wherein the steps of providing and installing inner segment means include the steps of providing and installing a plurality of arcuate-shaped inner segments that are of substantially identical configuration and are therefore interchangeable one with another.

143. The method of claim 141 wherein the steps of providing and installing inner segment means include the steps of providing and installing pairs of substantially identically configured, half-circle shaped inner segments.

144. The method of claim 141 wherein the steps of providing and installing inner segment means include the steps of providing and installing inner segments that define at least one of the associated radially outwardly facing surfaces such that it is of a truncated conical form that is inclined with respect to the associated radially inwardly facing surface so as to narrow the width of bottom portions of the associated inner seal positioning trough so that, as the associated inner seal is compressed within the associated trough by the seating thereatop of the associated inner enclosure of the furnace, the associated inner seal will continue to extend substantially the full radially measured distance between the associated pair of radially outwardly facing and radially inwardly facing surfaces at such locations within the associated trough as are occupied by the associated inner seal.

145. The method of claim 141 wherein the steps of providing and installing said inner segment means and said outer segment means include the steps of configuring and installing said inner segment means and said outer segment means such that at least one of an associated pair of radially inwardly facing and radially outwardly facing surfaces is of a truncated conical form that serves to narrow the width of bottom portions of the associated inner seal positioning trough so that, as the associated inner seal means is compressed within the associated trough by the seating of the associated inner enclosure or the furnace thereatop, the associated inner seal will continue to extend substantially the full radially measured distance between said associated pair of surfaces at such locations within the associated trough as are occupied by the associated inner seal.

146. The method of claim 141 wherein the steps of providing and installing said inner segment means and said outer segment means include the steps of configuring and installing said inner segment means and said outer segment means such that all of the inner seal positioning troughs maintain a substantially uniform cross-sectional configuration as they extend circumferentially about the charge support structures of the furnace, with said uniform cross-sectional configuration being tapered such that the inner seal positioning troughs narrow toward bottom regions thereof.

147. The method of claim 141 wherein the steps of providing and installing outer segment means include the steps of providing and installing four individual outer segments per outer segment sub-set to define an associated one of the radially inwardly facing surfaces, with at least a designated pair of the individual outer segments being shared with another of the sub-sets in the sense that each of the segments of said designated pair also defines portions of another of said radially inwardly facing surfaces.

148. The method of claim 147 wherein the step of providing and installing the outer segment means include the steps of providing and installing four individual outer segments per sub-set 1) in such a manner that each of the four individual segments defines at least the majority of a quarter circle portion of said one of the associated radially inwardly facing surfaces, and 2) in such a manner that each of the segments of said designated pair also defines at least the majority of a quarter circle portion of said another of the radially inwardly facing surfaces.

149. The method of claim 147 wherein the steps of providing and installing the outer segment means are carried out in such a way that at least one of the segments of said designated pair has an elongate outer portion that is installed to define a side part of said outer region of the rigid ceramic refractory base adjacent which the outer enclosure of the furnace is removably positioned during operation of the furnace.

150. The method of claim 149 wherein the steps of providing and installing the outer segment means are carried out in such a way that at least a selected outer surface area of said side part which may be engaged by the outer enclosure of the furnace during positioning of the outer enclosure adjacent said side part is reinforced by having its selected outer surface area formed from a cast refractory material that contains a sufficient volume of elongate, stainless steel, needle shaped members to provide said selected outer surface area with enhanced strength and wear resistance.

151. The method of claim 150 wherein the steps of providing and installing the outer segment means are carried out in such a way that the cast refractory material that is utilized to reinforce said selected outer surface area is formed as a pre-cast member that has steel anchor formation means extending therefrom for anchoring the pre-cast member to the cast refractory material from which adjacent other portions of said at least one side part is formed.

152. The method of claim 151 wherein the outer segments cooperate to define said outer region as being of generally rectangular shape, and wherein the steps of providing and installing the outer segment means are carried out in such a way that at least one of the individual outer segments defines a right-angle shaped outer portion that provides a corner part of said generally rectangular outer region.

153. The method of claim 152 wherein the steps of providing and installing the outer segment means are carried out in such a way that at least a selected outer surface area of said corner part is reinforced by having its selected outer surface area formed from a cast refractory material that contains a sufficient volume of elongate, stainless steel, needle shaped members to provide said selected outer surface area with enhanced strength and wear resistance.

154. The method of claim 153 wherein the steps of providing and installing the outer segment means are carried out in such a way that the cast refractory material that is utilized to reinforce said selected outer surface area is formed as a pre-cast member that has steel anchor formation means extending therefrom for anchoring the pre-cast member to the cast refractory material from which adjacent other portions of said corner part is formed.

155. The method of claim 151 wherein the steps of providing and installing the outer segment means are carried out such that the set of outer segments, when arranged side by side to cooperatively define said generally rectangular outer region, additionally define a substantially continuous, perimetrically extending, outwardly facing surface adjacent which an outer seal of the furnace can extend for being engaged by the outer enclosure of the furnace when the outer enclosure is positioned near outer region during operation of the furnace.

156. The method of claim 155 wherein the steps of providing and installing the outer segment means are carried out such that at least a portion of said perimetrically extending, outwardly facing surface is reinforced by forming said portion from a cast refractory material that contains a sufficient volume of elongate, stainless steel, needle shaped members to provide said portion with enhanced strength and wear resistance.

157. The method of claim 156 wherein the steps of providing and installing the outer segment means are carried out in such a way that the cast refractory material that is utilized to reinforce said outwardly facing surface is formed as a pre-cast member that has steel anchor formation means extending therefrom for anchoring the pre-cast member to the cast refractory material from which adjacent other portions of said outer segment means is formed.

158. The method of claim 141 wherein the steps of providing and installing outer segment means include the steps of providing and installing outer segments that cooperate to define portions of an outer seal trough wherein an outer seal of the furnace can be carried that engages the outer enclosure of the furnace when the outer enclosure is seated atop the outer segment means.

159. The method of claim 141 wherein the step of providing inner seal means includes the step of configuring the installed inner seals to each include a separate set of ceramic fiber blocks arranged serially in a circumferentially extending array within the confines of an associated one of said troughs, with each of said arrays also including a plurality of relatively thin, perforated metal members interspersed among the ceramic fiber blocks of the array to extend substantially radially at circumferentially spaced intervals within the confines of the associated trough, with said blocks having radially extending widths that are sufficient to extend substantially the full radially-measured distance between said radially outwardly facing surface and said radially outwardly facing surface of the associated trough at such locations therein as are to be occupied by said blocks, and with the blocks that are included in each array being sufficient in number and in size to require that said blocks be compressed in directions extending circumferentially with respect to the associated trough in order for all of said blocks to be inserted serially into the associated trough to form said array.

160. The method of claim 159 wherein the steps of providing and installing inner seal means include the steps of connecting a set of selected ones of the fiber blocks of one of the inner seals, and such thin metal members as are interspersed thereamong, to form an elongate module, and installing the module as a unit in the associated inner seal positioning trough.

161. The method of claim 160 wherein the steps of providing and installing inner seal means include the steps of including within the set of selected fiber blocks two fiber blocks that constitute end blocks inasmuch as they are located at opposite ends of the elongate module, and at least one central fiber block that is located between the two end blocks, and the step of connecting includes the step of inserting at least one elongate connector member to extend substantially centrally through the elongate module so as to extend through not only the end and central blocks but also through the perforated metal members that are included in the module.

162. The method of claim 161 wherein the steps of providing and installing inner seal means include the steps of including within the set of selected fiber blocks at least four central fiber blocks arranged serially between the two end blocks, and the step of connecting includes the step of inserting said elongate connector member to extend substantially centrally through all of the end and central blocks.

163. The method of claim 162 wherein the steps of providing and installing a module include the steps of incorporating in the module two metal members that constitute end members inasmuch as they are located at extreme opposite ends of the elongate module, and at least two central metal members that each are interposed between a separate adjacent pair of the set of selected fiber blocks, and the step of connecting includes connected opposite ends of the elongate connector member to said end members.

164. The method of claim 163 wherein the step of connecting includes the step of substantially uniformly compressing all of the fiber blocks of the set so that the length of said module as measured by the distance between the end members is less than it would be if the module were formed utilizing non-compressed fiber blocks.

165. The method of claim 164 wherein the step of substantially uniformly compressing the set of fiber blocks is carried out in such a way as to cause each of the blocks of the set to have a length, when compressed, that is about two-thirds of its non-compressed length.

166. The method of claim 160 wherein the step of forming the elongate module includes the step of forming the module such that it is substantially straight, and the step of installing the module in an associated trough includes the step of bending the module to an arcuate shape that corresponds to the curvature of the associated trough.

167. The method of claim 160 wherein the steps of providing and installing the inner seal means include the steps of providing and installing a plurality of said elongate modules, with each module including a separate set of fiber blocks together with such metal members as are interspersed thereamong.

168. The method of claim 167 wherein the steps of providing and installing the inner seal means include the steps of providing and installing a plurality of individual spacer fiber blocks, with a sufficient number of the spacer blocks being provided so that at least one compressed spacer block can be installed between each adjacent pair of the installed modules.

169. The method of claim 141 wherein the step of providing the inner seal means includes the step of providing ceramic refractory fiber blocks that have opposite end surfaces that are to be positioned in the associated trough so as to extend generally radially with respect to the associated trough, that have elongate fibers of ceramic refractory material, with the fibers of each block being sufficiently aligned so as to define a readily perceptible direction of orientation that extends substantially parallel to the opposed end surfaces of the block, and the step of installing the inner seal means includes the step of installing each of the fiber blocks in the associated inner seal positioning trough with the end surfaces of each block extending substantially radially with respect to the length of the associated trough, whereby the fibers of the blocks are oriented to extend generally in planes that extend substantially radially, not substantially circumferentially, with respect to the associated inner seal positioning trough.

170. The method of claim 169 wherein the step of providing inner seal means includes the step of providing said fiber blocks such that they have a substantially uniform width that is at least substantially equal to the maximum width of such portions of the associated trough as are to be occupied by said blocks; the steps of providing and installing said inner segment means and said outer segment means are carried out so that the associated trough, which is defined by a space located between said inner segment means and said outer segment means, is of tapered cross section with a progressively diminishing width being encountered at progressively deeper trough depths; and the step of installing the inner seal means is carried out by causing said blocks to be compressed in radially extending directions as said blocks are installed in the associated trough so that said blocks substantially fill the width of such portions of the associated trough as are occupied by said blocks.

171. The method of claim 169 wherein the step of providing the inner seal means includes the step of providing said perforated metal members in a form having a height that is less than the height of said fiber blocks, and the step of installing the inner seal means includes the step of inserting both the metal members and the fiber blocks to extend into bottom regions of the associated trough, with the metal members being sufficiently stiff to reinforce lower portions of the inner seal that is formed by said blocks and said members to prevent the inner from being crushed within the associated trough to a height that is less than the height of said metal members.

172. The method of claim 141 wherein the step of providing said inner segment means includes the step of mold-forming castable ceramic refractory material to mold a cast refractory inner segment while forcefully vibrating the mold to cause the castable ceramic material to flow properly to substantially fill all significant voids within the mold, and curing the molded cast refractory inner segment in a temperature controlled environment.

173. The method of claim 172 wherein the step of mold-forming castable ceramic refractory material includes the step of providing at least one anchor-carrying lift-engageable formation in said mold for being molded into the cast refractory inner segment, with the lift-engageable formation being accessible along an outer, upwardly-facing surface of the resulting cast refractory inner segment for connection to a crane to permit the cast refractory inner segment to be lifted by a crane during installation of the cast refractory inner segment.

174. The method of claim 141 wherein the step of providing said outer segment means includes the step of mold-forming castable ceramic refractory material to mold a cast refractory outer segment while forcefully vibrating the mold to cause the castable ceramic material to flow properly to substantially fill all significant voids within the mold, and curing the molded cast refractory outer segment in a temperature controlled environment.

175. The method of claim 174 wherein the step of mold-forming castable ceramic refractory material includes the step of providing at least one anchor-carrying lift-engageable formation in said mold for being molded into the cast refractory outer segment, with the lift-engageable formation being accessible along an outer, upwardly-facing surface of the resulting cast refractory outer segment for connection to a crane to permit the cast refractory outer segment to be lifted by a crane during installation of the cast refractory outer segment.

176. The method of claim 141 wherein the step of providing inner segment means includes the step of providing at least one cast refractory inner segment that has lift connection means anchored into the cast refractory material from which the segment is formed for defining three spaced lift attachment points to which connection can be made with a crane to permit the segment to be lifted and moved about, with each of the three spaced lift attachment points opening through a single outer surface of the segment that faces upwardly when said one inner segment is installed as a component of said refractory base, and the step of installing the cast refractory inner segment means includes the step of connecting each of the three lift attachment points of said one inner segment to crane, and operating the crane to lift and move said one inner segment into an installed position.

177. The method of claim 141 wherein the step of providing outer segment means includes the step of providing at least one cast refractory outer segment that has lift connection means anchored into the cast refractory material from which the segment is formed for defining three spaced lift attachment points to which connection can be made with a crane to permit the segment to be lifted and moved about, with each of the three spaced lift attachment points opening through a single outer surface of the segment that faces upwardly when said one outer segment is installed as a component of said refractory base, and the step of installing the cast refractory outer segment means includes the step of connecting each of the three lift attachment points of said one outer segment to a crane, and operating the crane to lift and move said one outer segment into an installed position.

178. A method of forming an elongate, upwardly facing seal of given length within an upwardly opening seal-positioning trough of an annealing furnace base, comprising the steps of:

a) providing a set of substantially identical ceramic fiber blocks that can be positioned in an end-to-end serial array having a non-compressed length that is greater than said given length, with the fibers of refractory material that comprise said blocks being of sufficient length so that, when the blocks are positioned in said array with their fibers extending substantially transversely relative to the length of the array, the serial array will have a transverse width that is slightly greater than is the width of such portions of the trough portions that are to be occupied by the blocks;

b) providing a plurality of relatively thin, perforated metal members that have lengths that are less than the width of said trough portions;

c) arranging said blocks to form said array with the thin metal members interspersed to extend among the blocks of the array; and, d) compressing-lengthwise and installing the array of blocks with metal members interspersed thereamong within said given length of the trough with the metal members extending transversely within the compressed array to enhance the crush resistance of the resulting seal.

179. The method of claim 178 additionally including the steps of installing a relatively thin lower blanket of ceramic fiber refractory material to underlie the compressed array as an additional element of the resulting seal.

180. The method of claim 178 additionally including the steps of installing a relatively thin upper blanket of ceramic fiber refractory material to overlie the compressed array as an additional element of the resulting seal.

181. The method of claim 180 additionally including the step of providing compression means extending longitudinally, centrally through the compressed array of blocks and interspersed metal members to hold the array compressed so that the resulting assembly can be installed in the trough as a module.

182. The method of claim 181 additionally including the step of forming a plurality of said modules, and installing selected ones of said modules in the trough in an end-to-end arrangement to provide a seal in more than said given length of the trough.

183. The method of claim 182 additionally including the step of installing blocks of fiber refractory material between adjacent ends of adjacent pairs of the installed modules, and positioning the adjacent ends to compress the installed blocks therebetween.

184. The method of claim 182 wherein the step of forming the modules includes the step of forming the modules such that they are of generally straight form, and the step of installing modules includes the step of bending selected modules sufficiently to conform the shape of the selected modules to a curved shape of such trough portions as are to be occupied by the selected modules.

185. A method of building a plural stack annealing furnace base in an off-site facility that is removed from a furnace site where the base is to be installed, wherein the facility has a crane of sufficient lift capacity to pick up at least one of each of the heavier base components which include a base support structure, a plurality of cast refractory inner segments, a plurality of cast refractory outer segments, comprising the steps of:

a) forming a plurality of welded steel base support structures at the off-site facility, with the base support structures being configured to be assemblable side-by-side define a base support for the furnace;

b) utilizing a crane of the off-site facility to individually lift the welded steel base structures onto flat bed vehicle means parked at the off-site facility;

c) forming cast refractory base assemblies by installing atop each of the base structures separate associated sets of cast refractory inner segments and separate associated sets of cast refractory outer segments;

d) moving the flat bed vehicle means from the off-site facility to a furnace location where the cast refractory base assemblies are to be installed;

e) utilizing a crane at the furnace location to connect with the welded steel base structures to lift the welded steel base structures together with the cast refractory base assemblies formed thereon from the flat bed vehicle means to position the welded steel base structures side-by-side at the furnace location.

186. The method of claim 185 additionally including the step of providing and lifting into place additional cast refractory segments that are needed to complete a new cast refractory base assembly at the furnace location.

187. The method of claim 185 additionally including the step of providing and installing resilient seal means in upwardly-facing troughs that are defined atop the welded steel base structures at locations between spaced ones of the installed cast refractory segments installed atop the welded steel base structures.

188. The method of claim 185 wherein the step of utilizing a crane at the furnace location to connect with the welded steel base structures to lift the welded steel base structures together with the cast refractory base assemblies formed thereon from the flat bed vehicle means includes the step of connecting to the welded steel base structures a lifting fixture is configured to minimize deformation of the welded steel base structures during lifting, and connecting the crane to the lifting fixture to lift the welded steel base structures by lifting the lifting fixture.

189. The method of claim 188 additionally including the steps of:

a) providing upstanding lifting arms affixed to opposite sides of the welded steel base structures at spaced intervals therealong for being connected to the lifting fixture; and, b) connecting the lifting fixture to said lifting arms to enable the lifting fixture to lift the welded steel base structures.

190. The method of claim 189 additionally including the step of cutting off portions of said lifting arms at a time after the welded steel base structures have been positioned side-by-side at the furnace location.

191. A method of carrying out an annealing process in a closed, controlled environment of a plural-stack annealing furnace, comprising the steps of:

a) providing a plural stack annealing furnace, including the steps of providing a base, providing a plurality of removable, open-bottom inner covers configured to cooperate with the base and to extend upwardly therefrom to define a plurality of side by side treatment chambers within which charges of metal can be simultaneously received and contained for being subjected to an annealing process, providing furnace structure configured to extend about the inner covers to provide heat energy for heating the contents of the treatment chambers during an annealing process, and providing seal means 1) connected to the base, 2) extending perimetrically and continuously about bottom regions of the treatment chambers, and 3) being configured to be compressively engaged by substantially continuous bottom rim portion of the open-bottom inner covers when the inner covers are positioned to cooperate with the base to define said treatment chambers i) for supporting at least a portion of the weight of the inner covers atop the base, and ii) for establishing seals between the base and the inner covers that will permit closed, controlled environments of desired character to be maintained within the treatment chambers during annealing of charges of metal contained therein;

b) supporting separate charges of metal on the base at locations within each of the treatment chambers for being annealed;

c) positioning the inner covers to extend about the base-supported charges of metal, with the bottom rim portions of the inner covers compressively engaging the seal means so as to establish seals between the base and the inner covers that isolate the environments of the treatment chambers, with the base and the inner covers cooperating to house the base-supported charges of metal within the isolated environments of the treatment chambers;

d) heating the base-supported, chamber-housed charges of metal within the isolated environment of the treatment chambers to initiate an annealing process of desired character while maintaining a gas atmosphere of desired character within the treatment chambers, and completing the conduct of the annealing process by continuing to control the treatment chamber environments;

e) withdrawing the inner covers from compressive engagements with the inner seals and from positions wherein the covers surrounded the charges of annealed metal so that the charges of annealed metal can be removed from atop the base;

f) wherein the step of providing a base includes the steps of:

1) providing inner base structure that defines a plurality of spaced, upwardly facing support surface locations for receiving and supporting the charges of metal that are to be annealed, and that defines about each of said locations an associated outer surface which extends perimetrically about its associated charge support location;

2) providing outer base structure that extends about the inner base structure, and that defines a separate substantially continuous inner surface to extends perimetrically about and to face generally toward each of the outer surfaces of the inner base structure at substantially uniform distances therefrom so as to define seal mounting troughs of substantially uniform width that extend continuously about the charge support locations, into which troughs the substantially continuous bottom rim portions of the open-bottom inner covers will extend when the inner cover is positioned to cooperate with the base to define said treatment chamber;

g) wherein at least a selected one of the steps of providing inner base structure and providing outer base structure includes the step of separately forming a plurality of cast refractory base components, and assembling said cast refractory base components to define major portions of such base structure.

192. The method of claim 191 wherein the step of providing seal means additionally includes the steps of providing a plurality of elongate insulation modules that are formed at least in part from fiber refractory material interspersed with sheets of perforated metal, and utilizing the elongate modules in a serial array to define at least a part of said seal means.

* * * * *

UNITED STATES PATENT AND TRADEMARK OFFICE

CERTIFICATE OF CORRECTION

PATENT NO. : 5,756,043

DATED : May 26, 1998

INVENTOR(S) : Gary L. Coble

Figure 12:
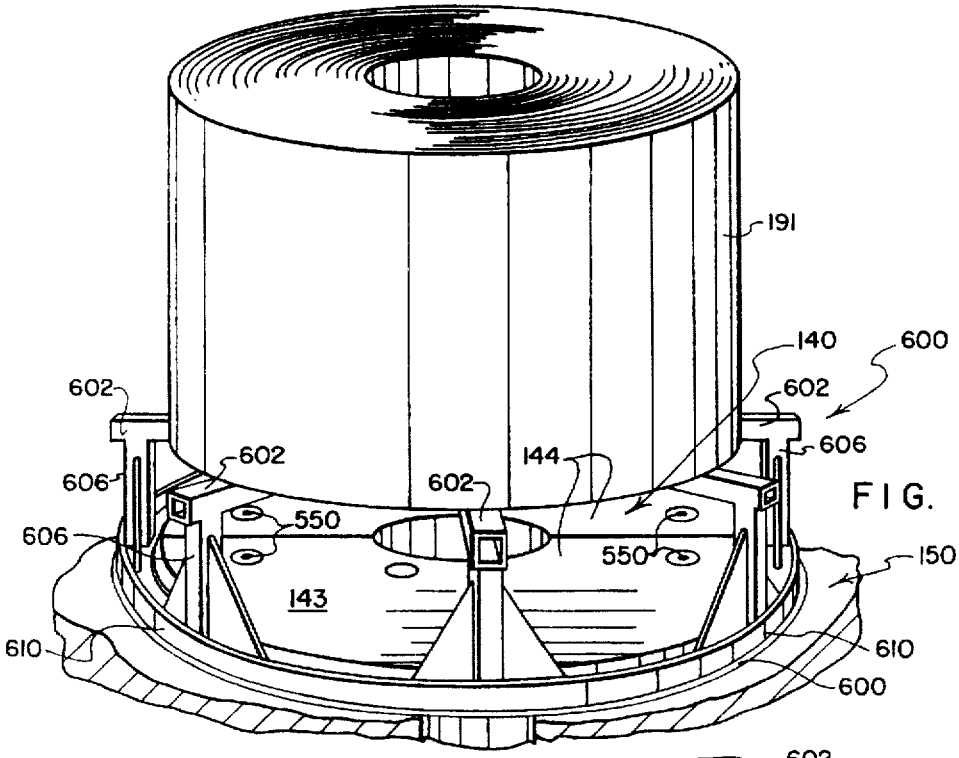
FIG. 12 is a perspective view showing the tool of FIG. 11 seated in engagement with a trough-carried inner seal, and having a heavy object, namely a coil of steel, resting atop the tool to provided needed weight.

It is certified that error appears in the above-identified patent and that said Letters Patent is hereby corrected as shown below:

Column 1, line 41, "No. 37,837" should read --No. 371,837--
Column 4, line 11, "Of" should read --of--
Column 6, line 60, "nents for" should read --nents) for--
Column 7, line 25, "If" should read --if--
Column 9, line 28, "Feature" should read --feature--
Column 12, line 55, "furnace 101" should read --furnace 100--
Column 13, line 65, "with depth" should read --with depth.--
Column 14, line 11, "Identical" should read --identical--
Column 17, line 10, "troughs 170," should read —troughs 110,—
Column 18, line 43, "product) which" should read --product) -which--
Column 19, line 6, "front" should read --from--
Column 19, line 26, "operated, are" should read —operated) are—
Column 19, line 59, "+0" should read --to--
Column 20, line 9, "Just" should read --just--
Column 20, line 62, "steel) with" should read --steel), with--
Column 21, line 56, "Fiber" should read --fiber--
Column 22, line 12, "If" should read --if--
Column 22, line 58, "FIGS. 112" should read --FIGS. 12--
Column 26, line 66, "is or" should read --is of--
Column 31, line 30, "then" should read --the--

Column 34, line 30, "retractor" should read --refractory--
Column 34, line 42, "separate-associated (one fit" should read --separate associated one of a--
Column 35, line 63, "Individual" should read --individual--
Column 37, line 8, "tree" should read --the--
Column 38, line 17, "inserter" should read --inserted--
Column 41, line 9, "to rim" should read --bottom rim--

UNITED STATES PATENT AND TRADEMARK OFFICE

CERTIFICATE OF CORRECTION

PATENT NO. : 5,756,043

DATED : May 26, 1998

INVENTOR(S) : Gary L. Coble

It is certified that error appears in the above-identified patent and that said Letters Patent is hereby corrected as shown below:

Column 45, line 27, "inner from" should read --inner seal from--

Signed and Sealed this

Third Day of November, 1998

*Attest:*

*Attesting Officer*

BRUCE LEHMAN

*Commissioner of Patents and Trademarks*